US008714130B2

(12) United States Patent
Mavinahally et al.

(10) Patent No.: US 8,714,130 B2
(45) Date of Patent: May 6, 2014

(54) INTEGRALLY CAST BLOCK AND UPPER CRANKCASE

(75) Inventors: Nagesh S. Mavinahally, Columbus, IN (US); Jay S. Veerathappa, Northridge, CA (US); Pushpalatha N. Mavinahally, Columbus, IN (US)

(73) Assignee: Nagesh S. Mavinahally, Columbus, IN (US)

( * ) Notice: Subject to any disclaimer, the term of this patent is extended or adjusted under 35 U.S.C. 154(b) by 503 days.

(21) Appl. No.: 12/907,360

(22) Filed: Oct. 19, 2010

(65) Prior Publication Data

US 2011/0088650 A1 Apr. 21, 2011

Related U.S. Application Data

(60) Provisional application No. 61/279,125, filed on Oct. 19, 2009.

(51) Int. Cl.
*F02B 61/04* (2006.01)

(52) U.S. Cl.
USPC ..... 123/195 R; 123/65 R

(58) Field of Classification Search
USPC ..... 123/195 R, 195 P, 65 R, 52.1, 311
See application file for complete search history.

(56) References Cited

U.S. PATENT DOCUMENTS

| | | | | | |
|---|---|---|---|---|---|
| 1,331,826 | A | | 2/1920 | Shepherd | |
| 1,838,080 | A | * | 12/1931 | Alexander | 123/41.69 |
| 2,218,332 | A | | 10/1940 | Fowler | |
| 2,305,891 | A | * | 12/1942 | Neuland | 123/41.31 |
| 2,326,329 | A | * | 8/1943 | Camp | 123/90.15 |
| 2,404,833 | A | * | 7/1946 | Forster | 123/73 DA |
| 2,513,563 | A | * | 7/1950 | Ikert | 123/73 A |
| 2,959,164 | A | | 11/1960 | Janeway et al. | |
| 3,967,600 | A | | 7/1976 | Iiyama et al. | |
| 4,513,702 | A | * | 4/1985 | Koga et al. | 123/193.5 |
| 4,588,358 | A | * | 5/1986 | Rietschle | 417/247 |
| 4,588,385 | A | * | 5/1986 | Suzuki et al. | 440/88 R |
| 4,709,671 | A | * | 12/1987 | Sumigawa | 123/196 S |
| 4,741,303 | A | * | 5/1988 | Kronich | 123/192.2 |
| 4,930,468 | A | | 6/1990 | Stockhausen | |
| 4,986,228 | A | | 1/1991 | Tharman | |
| 5,794,602 | A | * | 8/1998 | Kimura | 123/572 |

(Continued)

OTHER PUBLICATIONS

PCT/US2009/053088 Oct. 30, 2009—Search Report Patent Cooperation Treaty, International Searching Authority, Oct. 30, 2009, 16 pages.

*Primary Examiner* — Noah Kamen
*Assistant Examiner* — Long T Tran
(74) *Attorney, Agent, or Firm* — Steven J. Rosen

(57) ABSTRACT

An integrally cast four-stroke engine mono-block includes integrally cast cylinder block, cylinder head, and portion of a crankcase including crankcase outboard and inboard walls. At least parts of outer and inner bearing bosses are integrally cast with the cylinder block with the inner bearing boss integrally cast in the inboard wall. At least one cored out longitudinally extending open valve train chamber is disposed between the outboard wall and the cast cylinder block. An alternative embodiment of the integrally cast four-stroke engine mono-block includes at least parts of an outer bearing boss and/or an inner bearing boss integrally cast in the outboard and inboard walls respectively with the cast cylinder block. At least one cored out longitudinally extending open valve train chamber is disposed between the outboard wall and the cast cylinder block. Push tube passages or a belt drive passage may be in the valve train chamber.

49 Claims, 31 Drawing Sheets

(56) References Cited

U.S. PATENT DOCUMENTS

| | | | | |
|---|---|---|---|---|
| 5,918,574 | A | 7/1999 | Kobayashi | |
| 5,924,393 | A | 7/1999 | Kikuchi | |
| 5,924,400 | A | 7/1999 | Kobayashi | |
| 6,021,766 | A | 2/2000 | Maeda et al. | |
| 6,050,237 | A | 4/2000 | Ferrera et al. | |
| 6,119,648 | A | 9/2000 | Araki | |
| 6,152,098 | A | 11/2000 | Becker et al. | |
| 6,199,532 | B1 | 3/2001 | Haberlein et al. | |
| 6,213,079 | B1 | 4/2001 | Watanabe | |
| 6,250,273 | B1 | 6/2001 | Ryu et al. | |
| 6,328,012 | B1 * | 12/2001 | Clements | 123/188.4 |
| 6,408,803 | B1 * | 6/2002 | Atkins | 123/41.81 |
| 6,427,672 | B1 | 8/2002 | Ito et al. | |
| 6,508,224 | B2 | 1/2003 | Maeda et al. | |
| 6,539,904 | B2 | 4/2003 | Ito et al. | |
| 6,612,275 | B2 | 9/2003 | Immel et al. | |
| 6,644,290 | B2 | 11/2003 | Yoneyama et al. | |
| 6,672,273 | B2 | 1/2004 | Ito et al. | |
| 6,705,263 | B2 | 3/2004 | Ito et al. | |
| 6,772,726 | B2 | 8/2004 | Kawamoto et al. | |
| 6,925,970 | B2 | 8/2005 | Liu et al. | |
| 7,000,581 | B1 | 2/2006 | Mavinahally et al. | |
| 7,055,485 | B1 | 6/2006 | Davis et al. | |
| 7,243,632 | B2 | 7/2007 | Hu | |
| 7,424,886 | B1 | 9/2008 | Herzer | |
| 7,559,299 | B2 | 7/2009 | Brower et al. | |
| 7,814,879 | B2 | 10/2010 | Brower et al. | |
| 2002/0023631 | A1 * | 2/2002 | Ito et al. | 123/572 |
| 2003/0213458 | A1 * | 11/2003 | Kawamoto et al. | 123/196 W |
| 2009/0266330 | A1 | 10/2009 | Brower et al. | |

* cited by examiner

INTEGRALLY CAST BLOCK AND UPPER CRANKCASE

RELATED APPLICATIONS

This application claims the benefit of International Application No. PCT/US09/53088, filed Aug. 7, 2009, entitled "INTEGRALLY CAST BLOCK AND UPPER CRANKCASE"; of U.S. Provisional Application No. 61/279,125, filed Oct. 19, 2009, entitled "INTEGRALLY CAST BLOCK AND LUBRICATING SYSTEM FOR FOUR CYCLE ENGINES"; and of U.S. Provisional Application No. 61/252,685, filed Oct. 19, 2009, entitled "INTEGRALLY CAST BLOCK AND GASEOUS FUEL INJECTED GENERATOR ENGINE", which are all hereby expressly incorporated herein in their entirety.

BACKGROUND

Field of the Invention

The invention relates to internal combustion four-stroke engines and, more particularly, to integrally cast blocks containing cylinders and crankcase portions.

Conventional four-stroke engines have certain disadvantages because there are numerous parts as compared to two-stroke engines. The additional parts, for example include, valve trains consisting of intake and exhaust valves, followers in the case of push tube trains for transmitting motion from cam lobes to rockers, just rockers in the case of overhead cam and belt or chain drives for overhead cam types. Also included are cam gear or pulley as the case may be, valve springs and retainers, cam shafts, and cam covers in some cases. Also, the method of assembling the main components varies depending on how the cylinder, crankcase, crankcase cover, piston rod and crankshaft assemblies are made.

It is known in the prior art that four-stroke engines have cylinder blocks (with or without a separate cylinder head) and crankcases as the case may be with or without crankcase covers. For example, cylinders manufactured by MTD Southwest has a cylinder head integral with the cylinder and has a separate crankcase which has main bearings to support the crankshaft and a separate volute attached to the crankcase. The volute also has bosses for an ignition module. Another example is a Honda engine which has a cylinder block including a cylinder, where the upper half of the crankcase is integral with the cylinder block and a lower half of the crankcase which, when assembled together, support the main bearings. In this case, there is no separate crankcase cover and the belt drive for the overhead valve system is a wet type, where the upper and lower half of the crankcases together form a reservoir for the lubricating oil and the belt is completely enclosed. The enclosure is integral with the upper half of the crankcase. A similar design is used for a push tube type of valve train. Reference may be made to U.S. Pat. Nos. 6,539,904, 6,672,273, 6,427,672, 6,508,224, 6,705,263 (belt drive), and 6,021,766 (push tube).

Some Honda full crank engines have the crankcases split at an angle to the crankshaft as disclosed in U.S. Pat. Nos. 6,250,273 and 6,644,290. The front half of the crankcase is integral with the cylinder block and has bearing boss to support the front half of the crankshaft and the rear half of the crankcase has another bearing boss to support the outboard side of the crankshaft. The cam gear or the pulley for transmitting the motion to the overhead valves is in the outboard side. One disadvantage is that the U.S. Pat. No. 6,250,273 discloses the need for a cam side cover to hold the cam shaft and gear, as such the prior art requires additional parts, fasteners, and gaskets. In both U.S. Pat. Nos. 6,250,273 and 6,644,290, the crankshaft requires the outboard bearing support 132 to structurally support the crankshaft and cannot be built without support 132. In comparison, the presently disclosed engine has two bearing supports on the same side and does not need additional bearing support on the outboard side.

Another example of engines with push tubes are disclosed in U.S. Pat. Nos. 6,213,079, 7,243,632, and 6,119,648. Some engines use gears to transmit rotation from crankshaft to the overhead cam shaft, which is running at half the crankshaft speed as disclosed in U.S. Pat. Nos. 6,152,098 and 6,612,275. In most cases where the engine has a two piece block, the top or front half and lower or outboard half of the crankcase, the valve train is on the outboard side.

In the case of upper and lower halves of crankcases (or left and right halves as in Kioritz U.S. Pat. No. 6,119,648), the disadvantages are that the upper and lower halves are first assembled together and then the bearing bores are machined. They are taken apart for the final assembly. They are not interchangeable. A sealing gasket is used to seal the two halves. As such, the cost of such a system is higher than the one proposed in the design disclosed herein. Simpler designs as disclosed in U.S. Pat. Nos. 7,559,299 and 2,218,332 which include mono-block two-stroke engine designs. However, the two-stroke engines do not have valve train or valves and therefore are simpler to manufacture. Secondly, the passages provided are for transfer passages connecting the crankcase chamber directly to the bottom of the cylinder to the combustion chamber have function to communicate between the crankcase chamber and combustion chamber and do not have valve train the passages and cannot be constructed to have the valve train in the transfer passage. U.S. Pat. No. 6,199,532 discloses an engine in which an intake passage is not divided into separate passages and the fuel is pre-mixed with oil and the valve chamber is substantially spaced above the combustion chamber. U.S. Pat. No. 4,513,702, discloses a valve train having a cam shaft perpendicular to the crankshaft axis necessitating dual cams, one each for intake and the exhaust valve, as such a single cam lobe as disclosed in this invention cannot be fitted into the design disclosed in U.S. Pat. No. 4,513,702. Also, the opening is inclined and overhead cam shaft cannot be driven by a belt.

Thus, engine designers are constantly trying to design engines that have less parts, are simpler, and less expensive to manufacture.

BRIEF SUMMARY OF THE INVENTION

An integrally cast internal combustion engine mono-block includes integrally cast cylinder block, cylinder head, and portion of a crankcase including crankcase outboard and inboard walls. At least parts of outer and inner bearing bosses are integrally cast with the cylinder block with the inner bearing boss integrally cast in the inboard wall. At least one cored out longitudinally extending chamber is disposed between the outboard wall and the cast cylinder block. The chamber is open at least at its chamber bottom and may be open at both its top and bottom such as when it is used as a valve train chamber for a four-stroke engine. The crankcase has a crankcase opening at a longitudinally lower end of the mono-block extending from a portion of an outer periphery of a longitudinally lower part of the cylinder block to a bottom portion of the outboard wall of the crankcase. An open bottom or lower opening of the chamber is located fully inboard of the crankcase opening.

An alternative embodiment of the integrally cast engine mono-block includes integrally cast cylinder block, cylinder head, and portion of a crankcase including crankcase outboard and inboard walls and at least parts of an outer bearing boss and/or an inner bearing boss integrally cast in the outboard and inboard walls respectively with the cast cylinder block. At least one cored out longitudinally extending open valve train chamber is disposed between the outboard wall and the cast cylinder block.

The integrally cast engine mono-block for a four-stroke engine may further include one or more cored out train passages in the valve train embodiment of the chamber such as push tube passages or a belt drive passage. The mono-block may further include an outer ignition boss integrally cast with the block. A portion of an outboard bearing boss such as an upper half of the outboard bearing boss may be integrally cast with the block. The mono-block may include a crankcase inboard wall integral with the block and at least portions of outer and inner bearing bosses in the outboard and inboard walls respectively.

Another alternative embodiment of the integrally cast mono-block for the four-stroke engine includes integrally cast cylinder block, cylinder head, and portion of a crankcase including crankcase outboard and inboard walls and an outboard wall extension. An outboard bearing boss is disposed in the outboard wall extension and first and second bearing bores in the outboard and inboard walls respectively. At least one cored out longitudinally extending open valve train embodiment of the chamber is disposed between the outboard wall and the cast cylinder block.

An integrally cast four-stroke engine L-head mono-block includes integrally cast cylinder block, L-head, and portion of a crankcase including crankcase outboard and inboard walls. At least parts of an outer bearing boss and/or an inner bearing boss are integrally cast in the outboard and inboard walls respectively with the cast cylinder block. At least one cored out longitudinally extending open valve train embodiment of the chamber is disposed between the outboard wall and the cast cylinder block and the L-head covers the valve train chamber and a cylinder bore disposed within the cylinder block and spaced apart from inboard wall.

BRIEF DESCRIPTION OF THE DRAWINGS

FIG. 1*bb* is a cross-sectional side view illustration of a mono-block for a two-stroke engine.

FIG. 9*bb* is a cross-sectional side view illustration of a mono-block having integrally cast cylinder block, crankcase, cylinder head, and bearing boss in the engine illustrated in FIG. 7.

DETAILED DESCRIPTION

Figure 1:
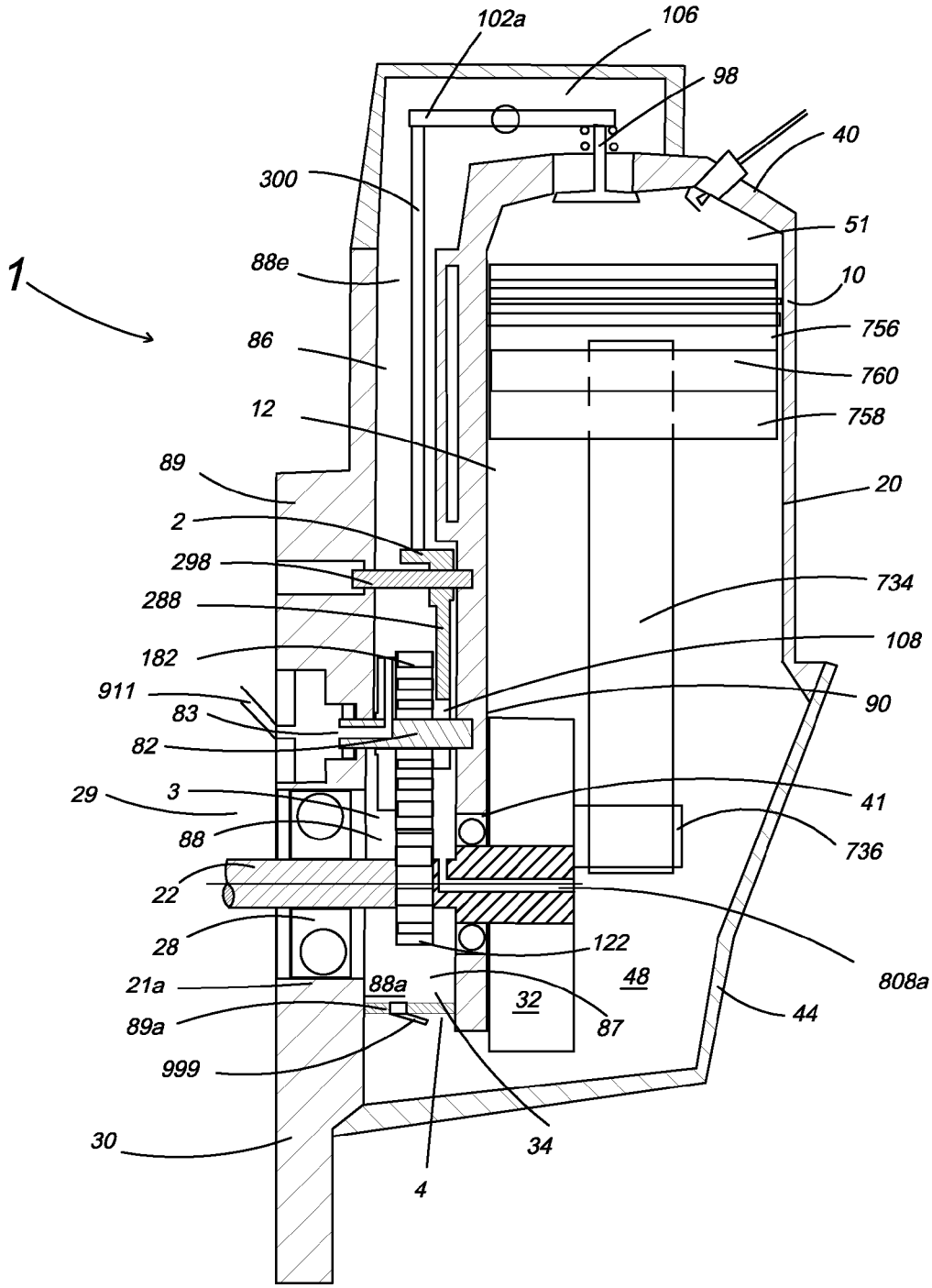
FIG. 1 is a cross-sectional side view illustration of an exemplary embodiment of a half-crank mono-block four-stroke engine with a push tube valve train where the cam chamber is plugged at its bottom.

FIGS. 1, 1*b*, 1*c*, and 1*d* illustrate an exemplary embodiment of a half-crank mono-block four-stroke engine 1 with a push tube valve train 2 and a cam chamber 3 plugged at its cam chamber bottom 4. The engine 1 includes a one half-crank mono-block 10 having a longitudinally extending cylinder block 20 surrounding a cylinder bore 12, a crankcase 30, and cylinder head 40 all integral as a mono-block as further illustrated in FIG. 1*b*. The crankcase 30 includes integrally cast crankcase outboard and inboard walls 89 and 90 which are integrally cast with the cylinder block 20. The crankcase 30 includes outer and inner bearing bosses 21*a* and 21*b* in the crankcase outboard and inboard walls 89 and 90 respectively configured to support a half crankshaft 22. The inner bearing boss 21*b* supports an inner bearing 41 closest to a counter-weight 32 on the crankshaft 22. The counter-weight 32 is inboard of the inner bearing 41. An outer bearing 28 is supported by the outer bearing boss 21*a* on a flywheel side 29 of the outboard wall 89 of the crankcase 30 which includes at least a portion of an outer frame 25 of the crankcase 30.

The outer frame 25 is spaced apart from the cylinder block 20. A piston assembly 756 disposed within the cylinder bore 12 includes a generally cylindrical piston 758 and a connecting rod 734 connected to the piston 758 by a piston pin 760. A crank pin 736 operably connects the connecting rod 734 to the counter-weight 32 on the crankshaft 22. In a full crank engine, an outer oil seal may replace the outer bearing. The outer frame 25 may be designed either for a reverse or forward air flow. Reverse air flow is where the frame has openings around the outer circumference for flow of air from behind the engine and forward air flow has openings in the front housing for flow of air. The combination of forward and reverse air flow has openings in the frame 25 as well as in the front housing for flow of air.

Figure 9:
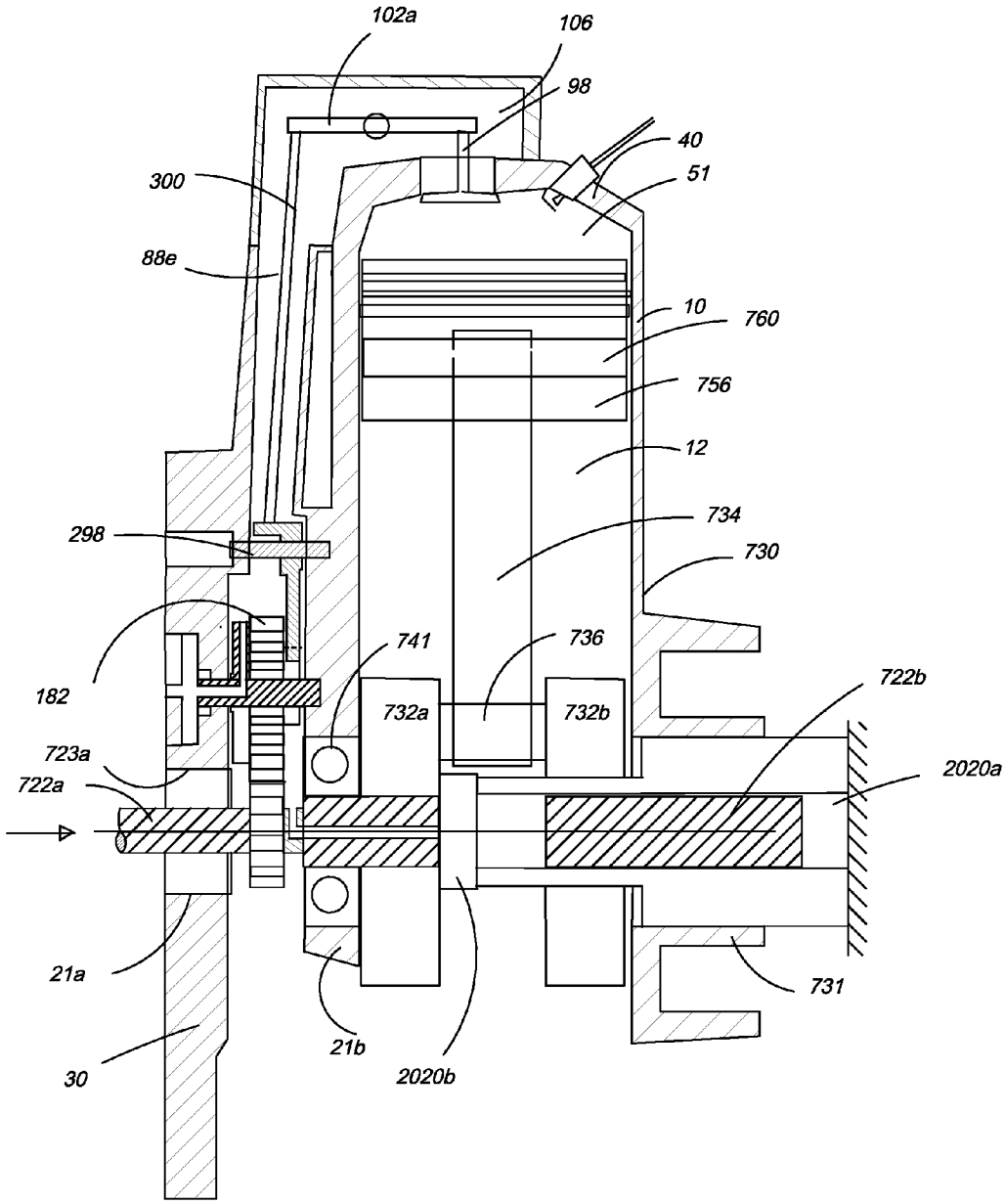
FIG. 9 is a cross-sectional view illustrating main shaft being pressed into the counter-weight in the engine illustrated in FIG. 7.
Figure 9B:
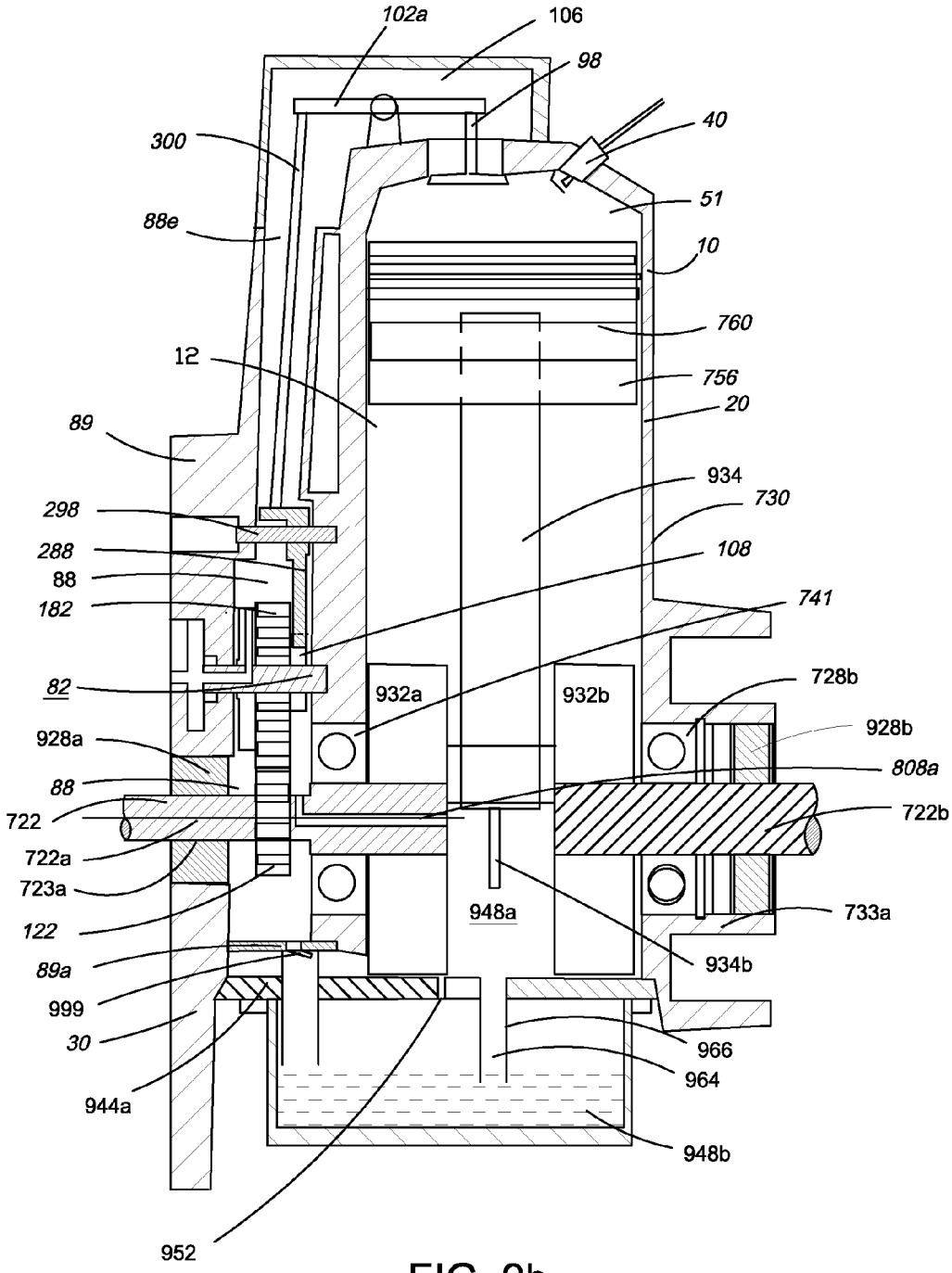
FIG. 9*b* is a cross-sectional view illustration of the engine illustrated in FIG. 9 with an oil chamber attached to a bottom of a crankcase.
Figure 9B:
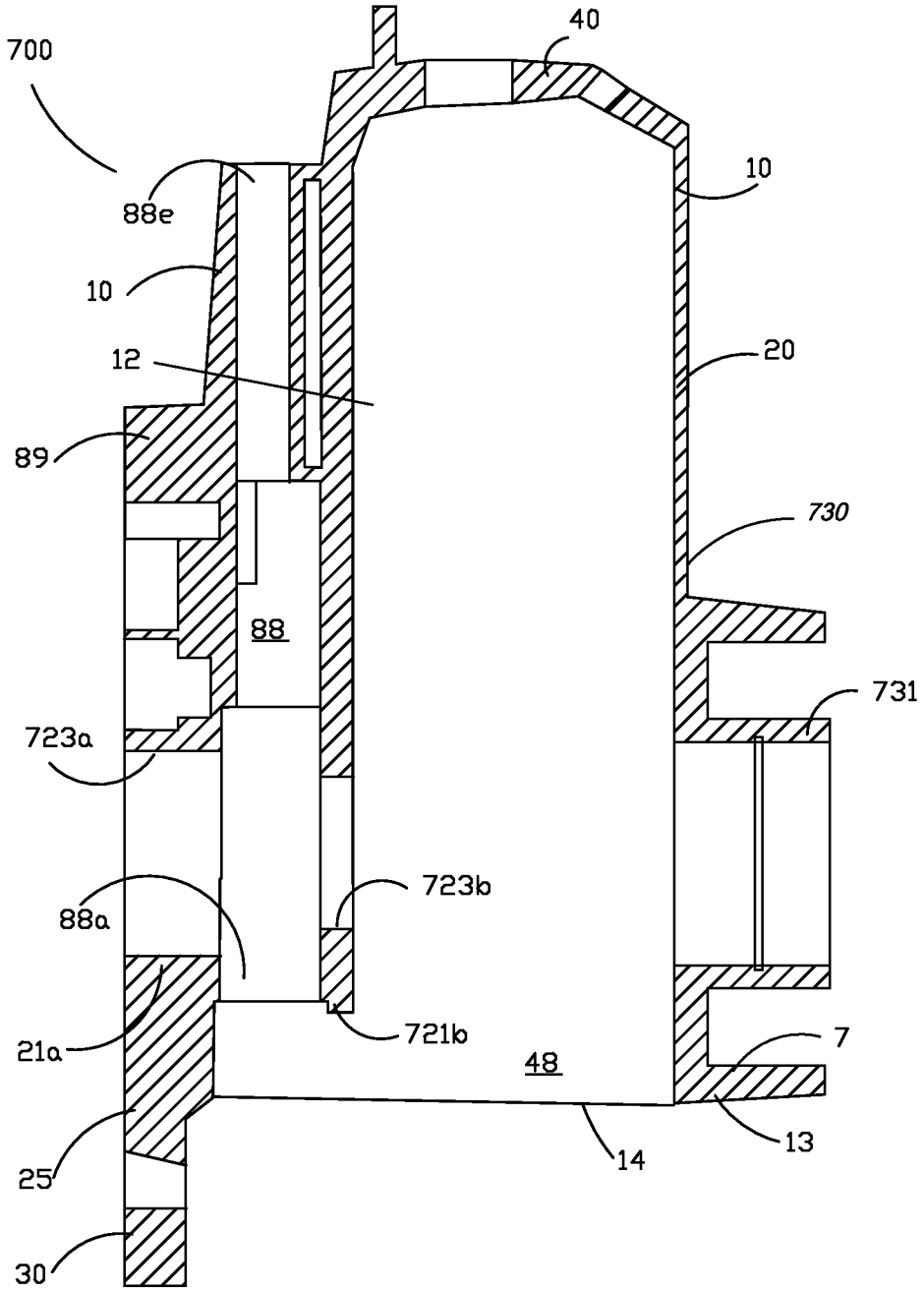

A longitudinally extending chamber 88 or passage is laterally disposed in the mono-block 10 directly between the outboard wall 89 and the cylinder block 20 and includes an open bottom or lower opening 88*a* at a lower end 87 of the chamber 88 that may be closed with a cover 89*a* as illustrated in FIG. 9*b*, if necessary, or the lower end 87 may be directly open to a crankcase chamber 48. If the mono-block 10 is for a four-stroke engine then the chamber 88 is a valve train chamber having an open top end 86 located near the cylinder head 40. The top end 86 is open to allow the valve train 2 to transmit motion from crankshaft 22 to an intake valve 98 and to an exhaust valve (not illustrated) which is behind the intake valve 98. If the mono-block 10 is for a two-stroke engine then the chamber 88 has a closed top end 86 (as illustrated in FIG. 1*bb*).

Figure 1B:
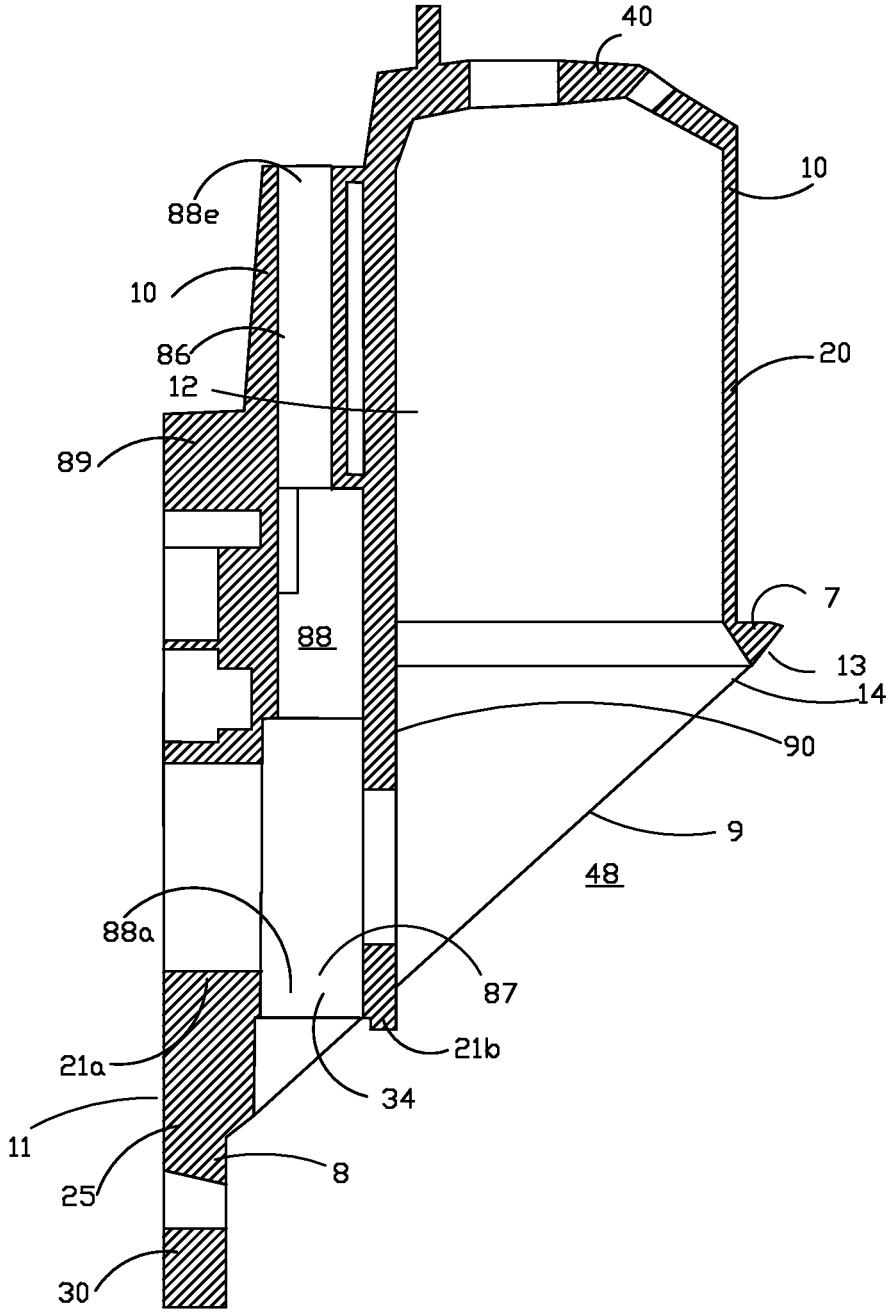
FIG. 1*b* is a cross-sectional side view illustration of a mono-block having integrally cast cylinder block, crankcase, cylinder head, and outer and inner bearing bosses in the engine illustrated in FIG. 1.
Figure 1B:
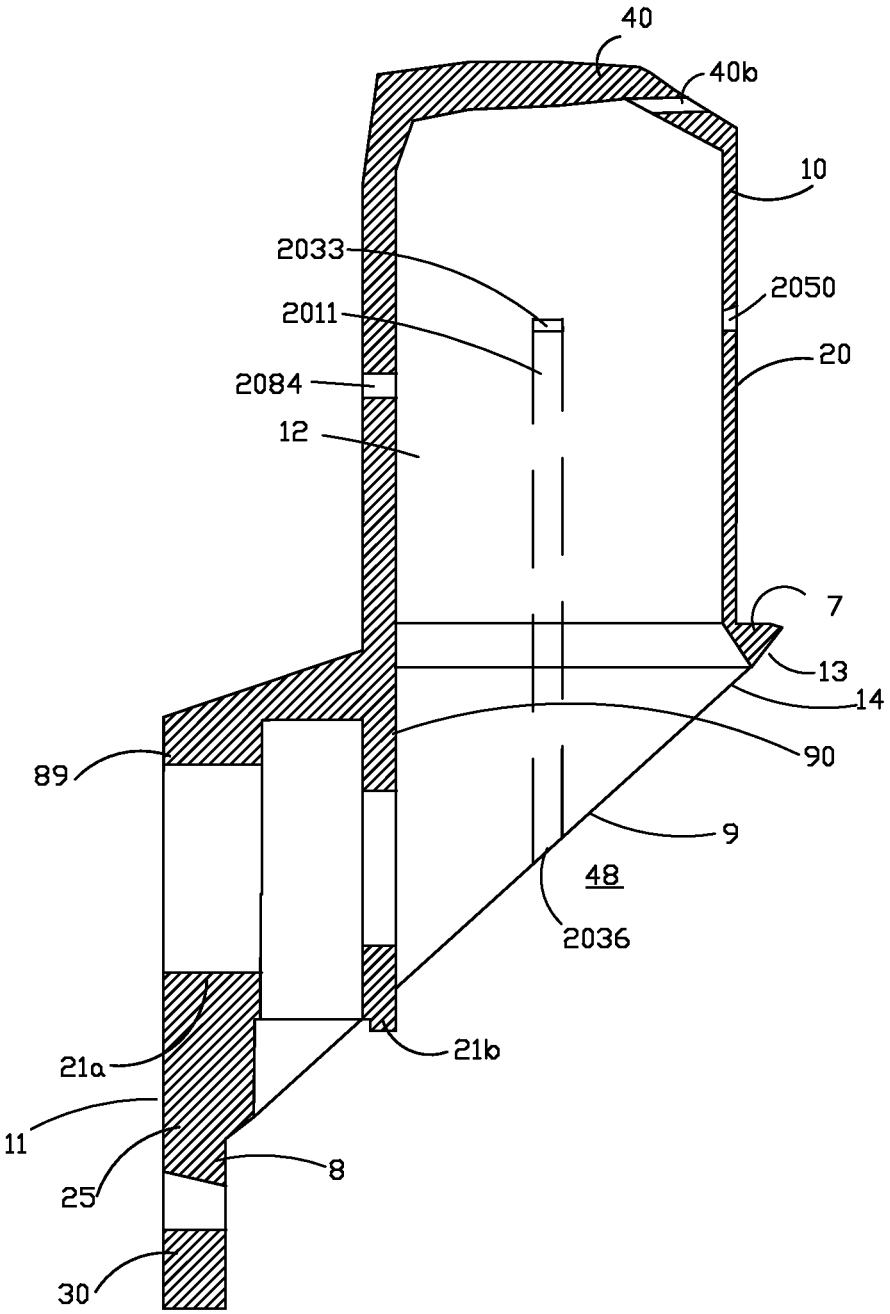
Figure 1C:
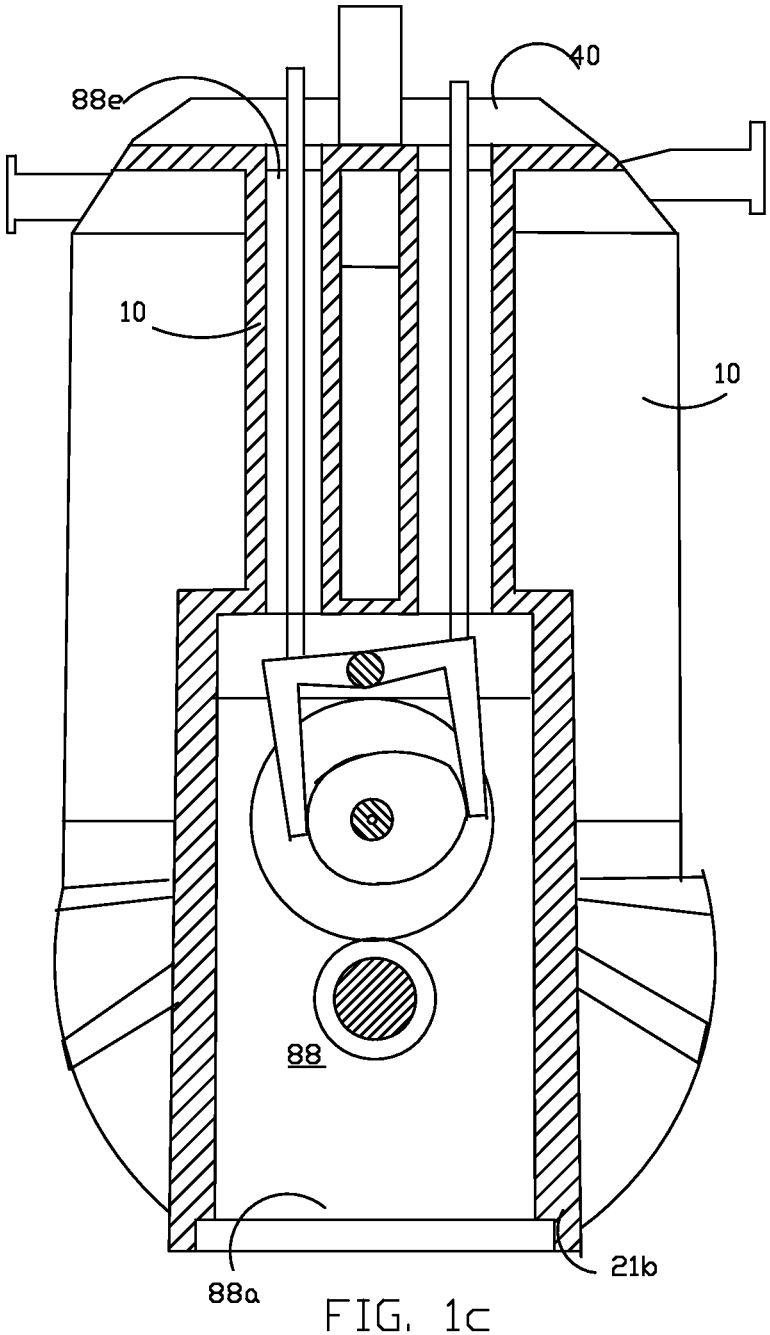
FIG. 1*c* is a cross-sectional front view illustration of the engine illustrated in FIG. 1.
Figure 1D:
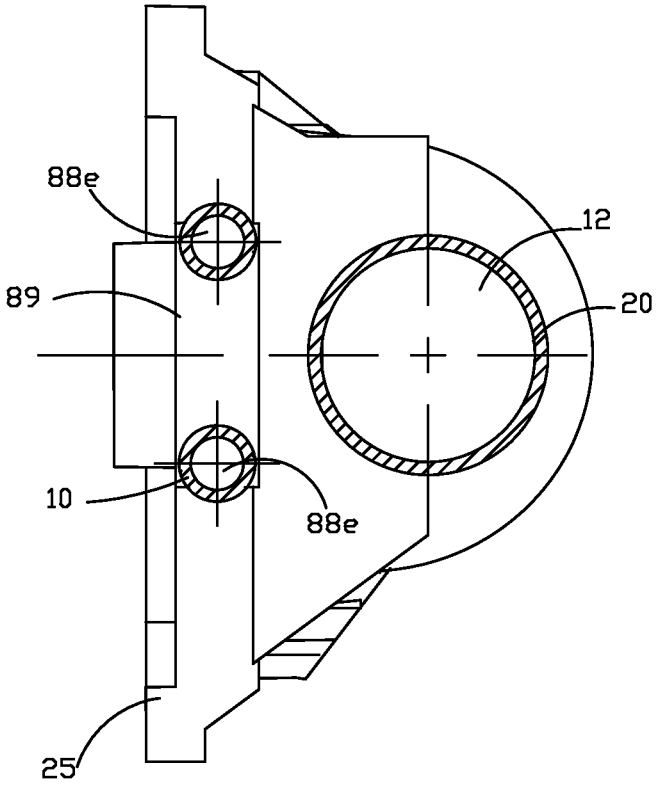
FIG. 1*d* is a cross-sectional top view illustration of the engine illustrated in FIG. 1.

The engine further includes inner and outer bearing bosses 21*a* and 21*b* in the crankcase outer and inner walls respectively, an outboard wall 89 integral with the cast cylinder block 20, at least one cored out longitudinally extending slot disposed between the between the outer bearing boss 21*a* and inner bearing boss 21*b* having at least one transfer passage 2011, transfer port 2033 at the upper end of the transfer passage 2011 open into the combustion chamber 30, a port 2036 at the lower end of the transfer passage 2011, an intake port 2084, spark plug hole 40*b*, and an exhaust port 250 is shown in FIG. 1*bb*. An oil pump may be disposed in the lower end of the transfer passage 2011 and may be attached to the outer wall 89 or the inner wall 90.

The crankcase 30 has a crankcase opening 9 at a longitudinally lower end 11 of the mono-block 10 extending from a portion 7 of an outer periphery 14 of a longitudinally lower part 13 of the cylinder block 20 to a bottom portion 8 of the outboard wall 89 of the crankcase 30. The lower opening 88*a* of the chamber 88 is located fully laterally inboard of the crankcase opening 9 to provide longitudinally straight access through the crankcase opening 9 to the lower opening 88*a* and the chamber 88. The frame 25 extends down from the outboard wall 89 and at least a portion of the frame 25 is integrally cast with the outboard wall 89.

The intake valve 98 and the exhaust valve are located in a valve chamber 106 above the cylinder head 40 and a spark plug 40*b* mounted in the cylinder head 40. A combustion chamber 51 in the cylinder head 40 defining an upper portion of the cylinder bore 12. The valve train 2 includes cam gear 182, cam lobe 108, followers 288, and push tubes 300 (also referred to as push rods). The valve train chamber 88 houses crank gear 122 and cam gear 182 with the followers 288. The valve train chamber 88 is formed, such as by casting, so that there is at least one slot 34 between the outer bearing boss 21*a* and the inner bearing boss 21*b* at the lower end of the valve train chamber 88. The slot 34 illustrated in FIGS. 1 and 1*b* is the lower end 87 of the valve train chamber 88.

The valve train chamber 88 is cored out using a slide in casting tool. The push tubes 300 may be disposed in one or more train passages such as push tube passages 88*e* in the valve train chamber 88. The train passage may also be a belt drive passage 1288*e* illustrated in FIG. 12. It may also be possible to core out part of push tube passages 88*e* and/or the belt drive passage 1288*e* in the valve train chamber 88, together with the entire valve train chamber 88. Thus, the mono-block 10 allows coring out of the valve train chamber 88 or belt drive passage 1288*e* from the crankcase chamber 48 to form a single piece block without any additional cover piece or machining process.

Figure 12:
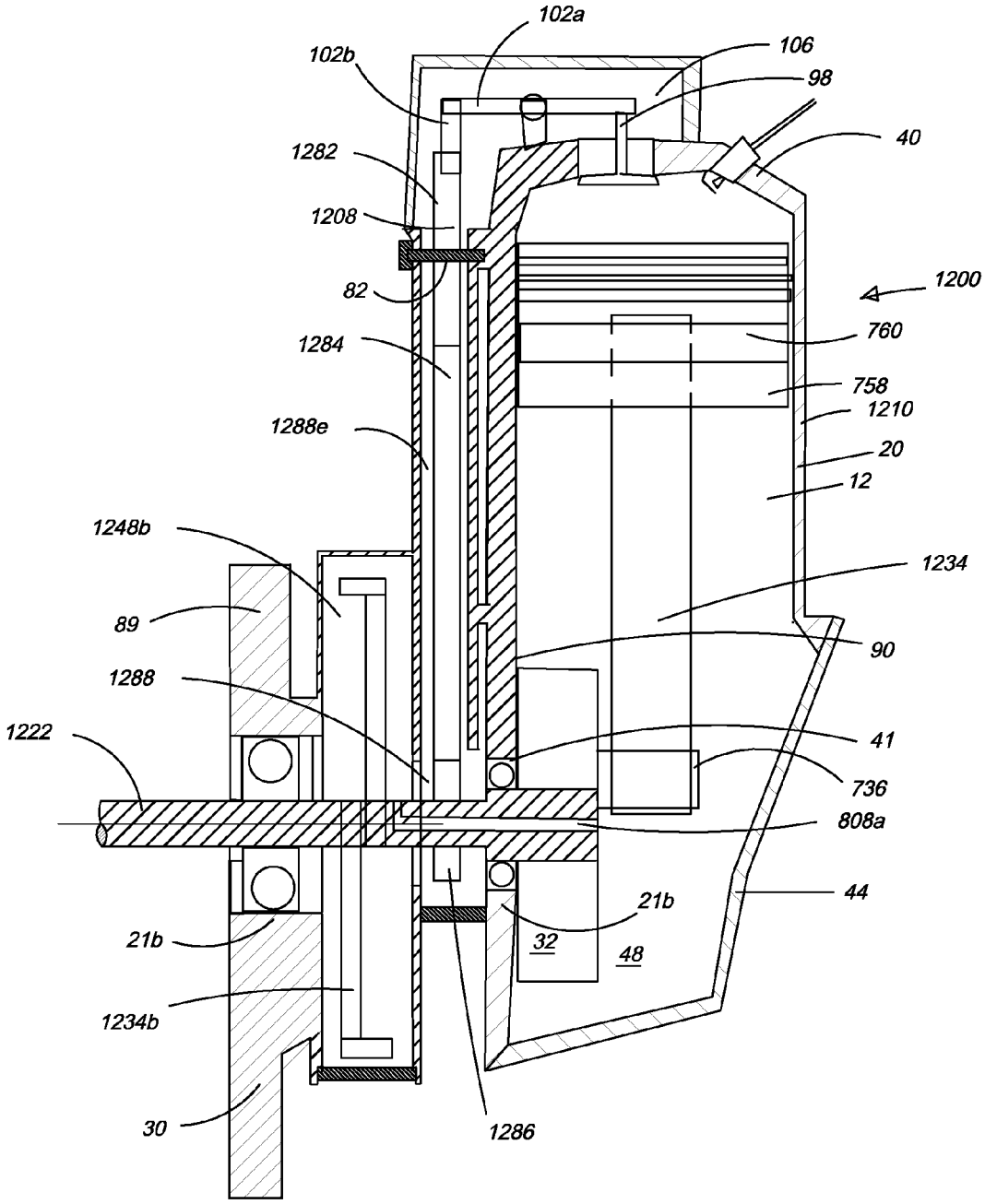
FIG. 12 is a cross-sectional side view illustration of another embodiment of the mono-block four-stroke engine with a belt driven overhead cam and an oil chamber and a slinger.

The top end 86 of the valve train chamber 88 may be open to the overhead valve chamber 106 through the cast in push tube passage (or passages) 88*e* or may be just open for a dry type belt drive as illustrated in FIG. 12 or a passage for the wet type belt drive to drive the overhead cam shaft through a cam gear or a pulley as the case may be.

Figure 4:
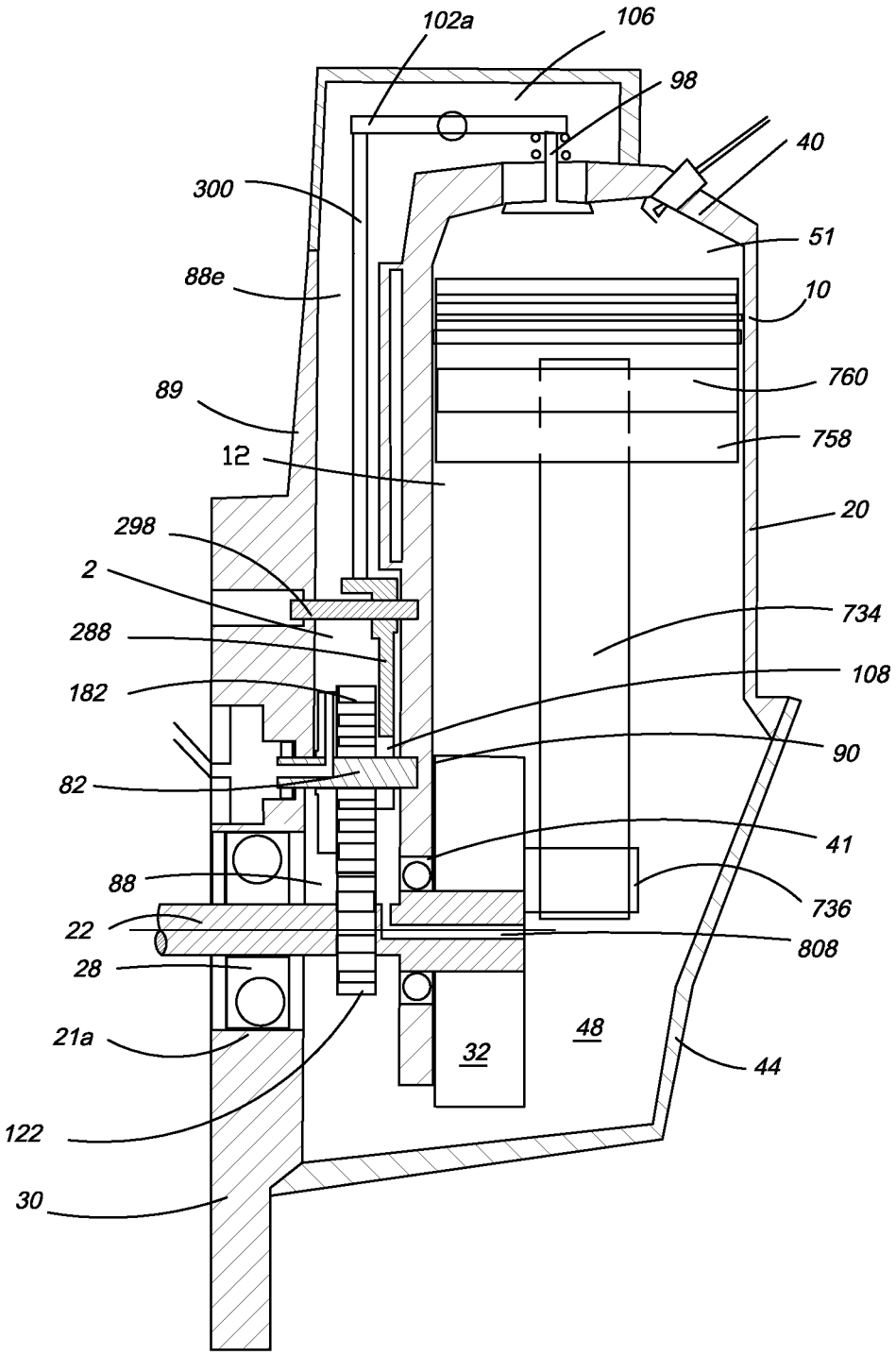
FIG. 4 is a cross-sectional side view illustration of a second exemplary embodiment of a half-crank mono-block four-stroke engine with a push tube valve train where the cam chamber is open at its bottom and the cam chamber and crankcase chamber are in communication through a cut-out passage.
Figure 5:
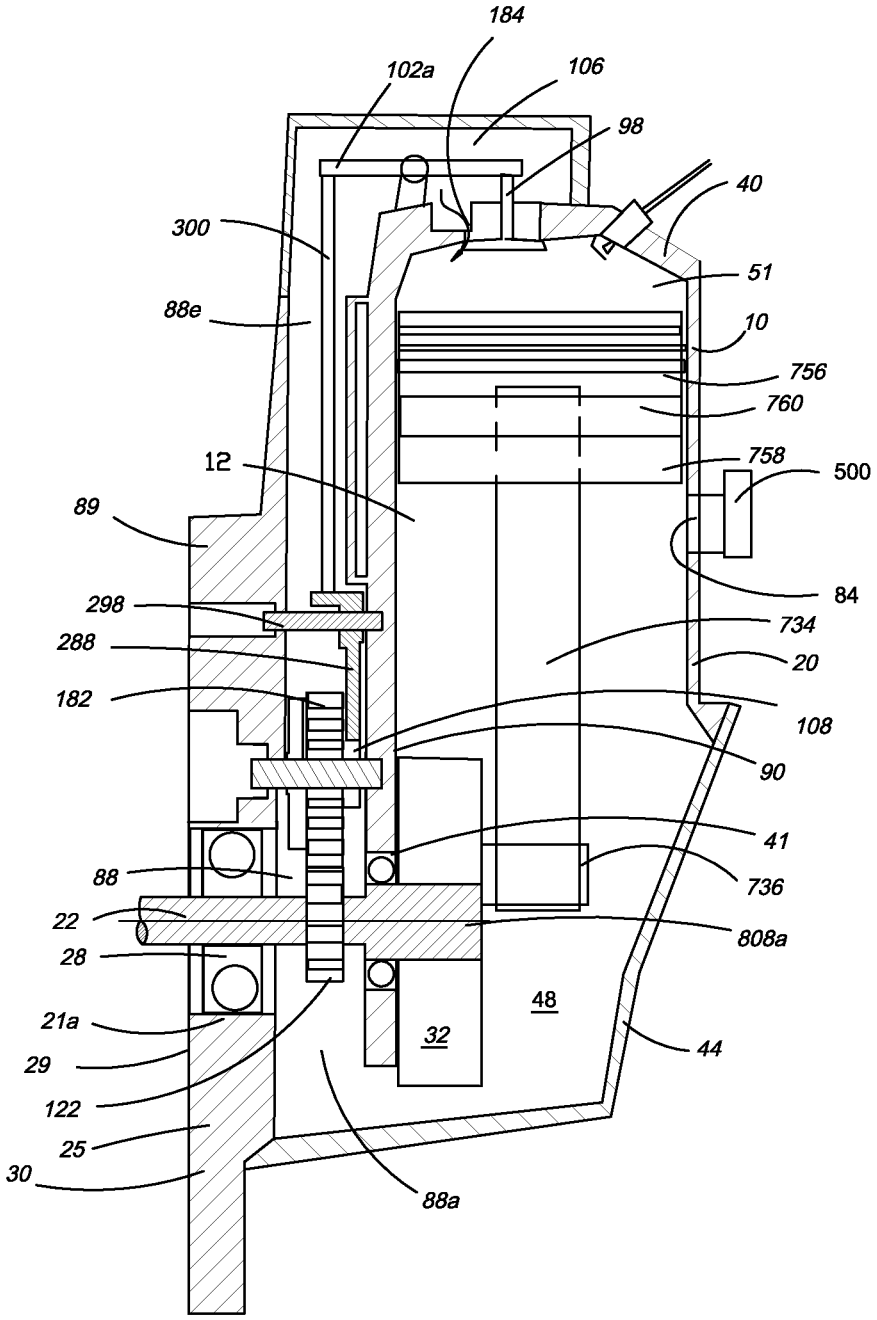
FIG. 5 is a cross-sectional side view illustration of a third exemplary embodiment of a half-crank mono-block four-stroke engine with a carburetor for supplying pre-mixed lubrication and air-fuel mixture.
Figure 5B:
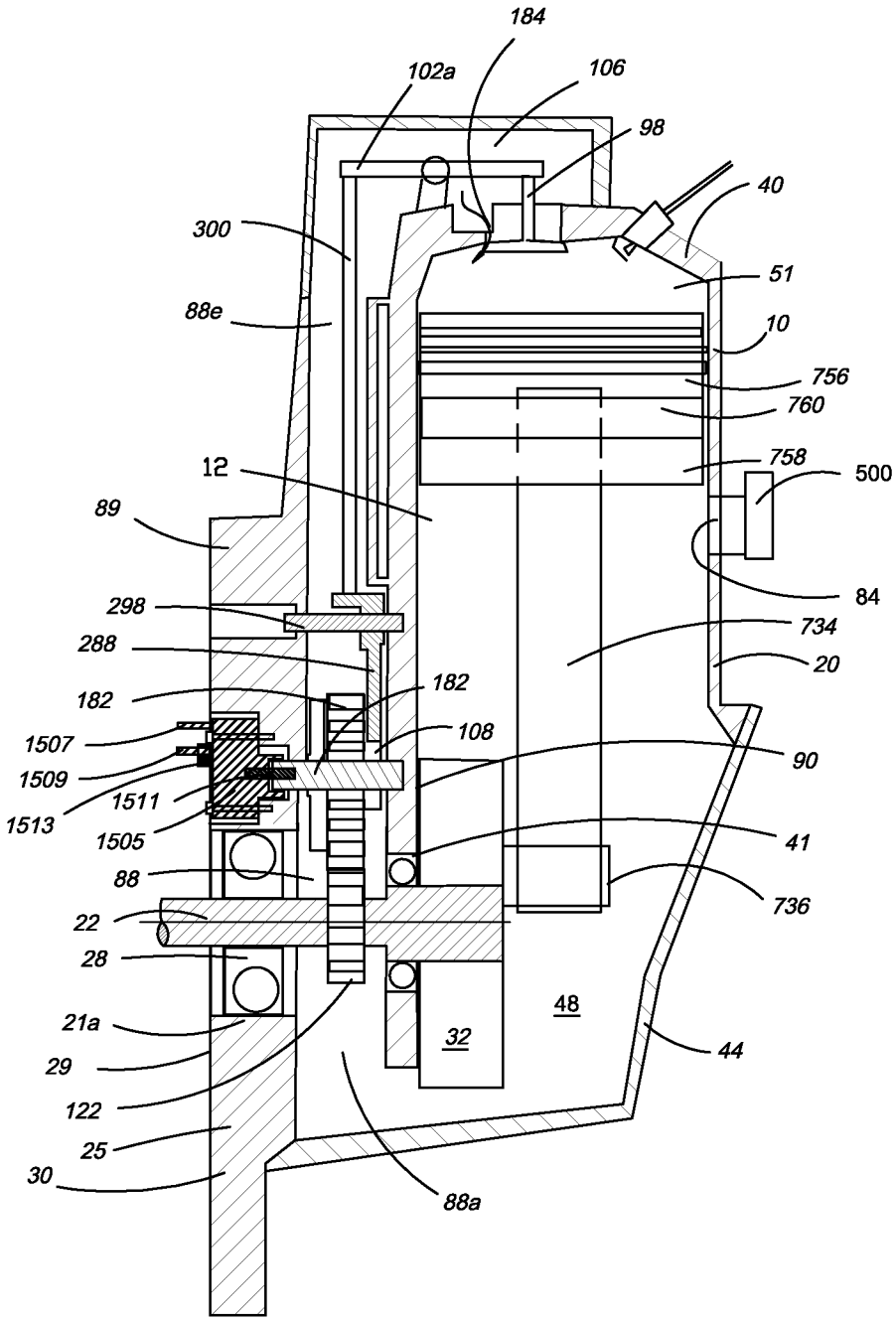
FIG. 5*b* is a cross-sectional side view illustration of another exemplary embodiment of a mono-block four-stroke engine with a cam shaft driven oil pump.

An embodiment of the engine 1 illustrated in FIGS. 4, 5 and 5*b* includes a single continuous valve train chamber 88 extending between the crankcase chamber 48 and the overhead valve chamber 106 (or overhead cam chamber if belt driven). The valve train chamber 88 is a single continuous passage from the crankcase chamber 48 to the valve chamber 106 without any other additional piece attached as a cover to provide an enclosed passage and no separate push tube passages 88*e*. FIG. 5 illustrates how the air-fuel mixture may be supplied into the crankcase chamber 48 through a port 84 in the cylinder block 20 by a carburetor 500. The function of the piston ported intake system is similar to a commonly used two-stroke engine. However, the lube oil mixed charge enters a crankcase chamber 48 and flows into a combustion chamber 51 through an intake valve 98. The intake system may be similar to any standard intake system, such as reed valve or rotary valve system. The mixture enters the valve train chamber 88 through the opening 88*a* from the crankcase chamber 48 and into valve chamber 106 and into the combustion chamber 51 through a passage 184 between the valve chamber and the combustion chamber 51 when the intake valve 98 is opened.

Figure 12B:
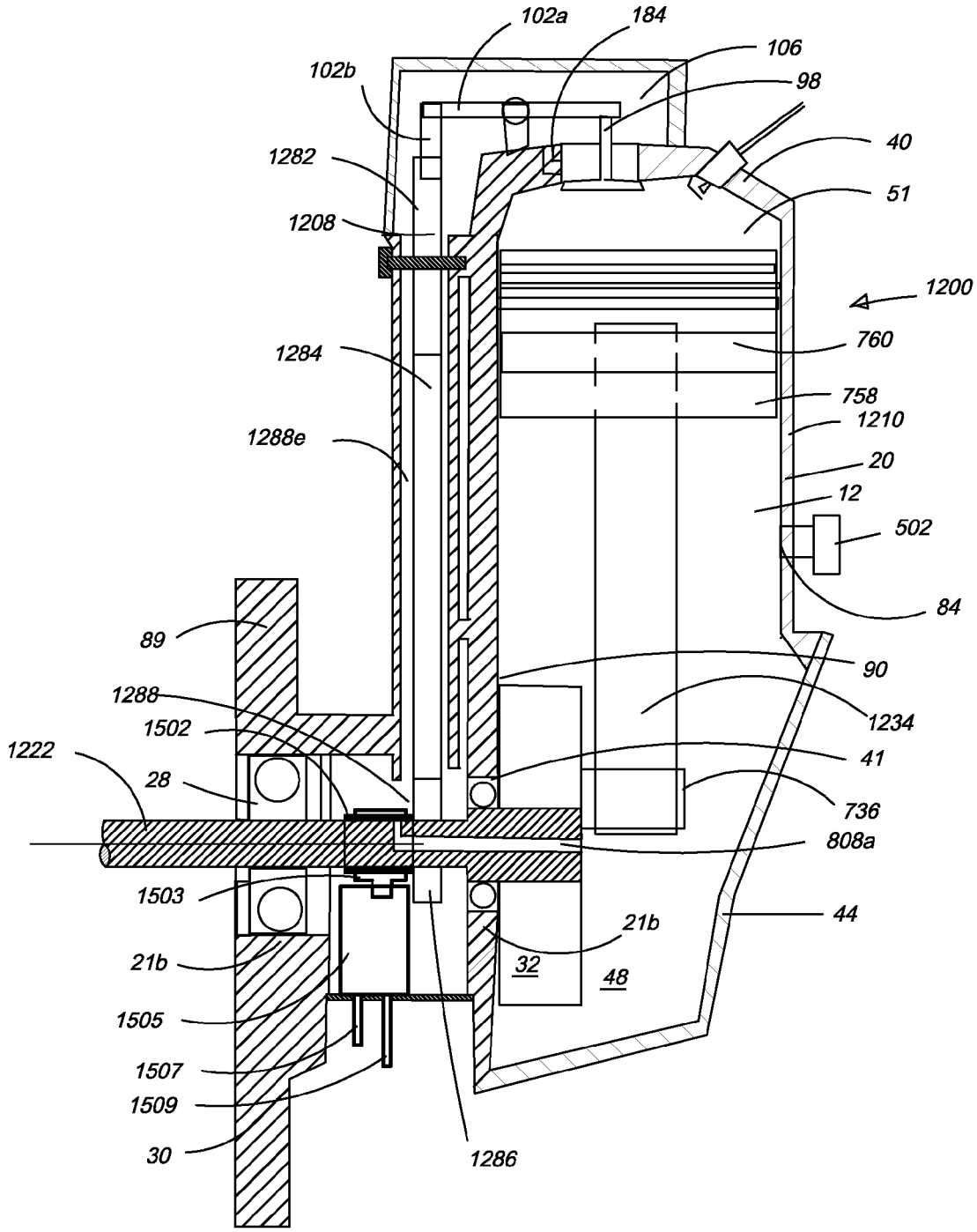
FIG. 12*b* is a cross-sectional side view illustration of another embodiment of the mono-block four-stroke engine with a belt driven overhead cam and an oil pump driven by the crankshaft.

A cam shaft 82 driven oil injection pump 1505 illustrated in FIG. 5*b* is used for injecting oil into a first intake passage 126*a* or directly into the crankcase chamber 48. The oil injection pump 1505 is coupled to the cam shaft through a coupler or a gear system 1511. The oil injection pump may use a pressure sensor 1513 (or an oil level sensor in the oil reservoir, not shown) to kill the engine when oil pressure in the outlet 1509 falls below a predetermined value to prevent the engine from seizure. The oil injection pump 1505 may be driven directly by the crankshaft 22, as shown in FIG. 12*b*.

Figure 6:
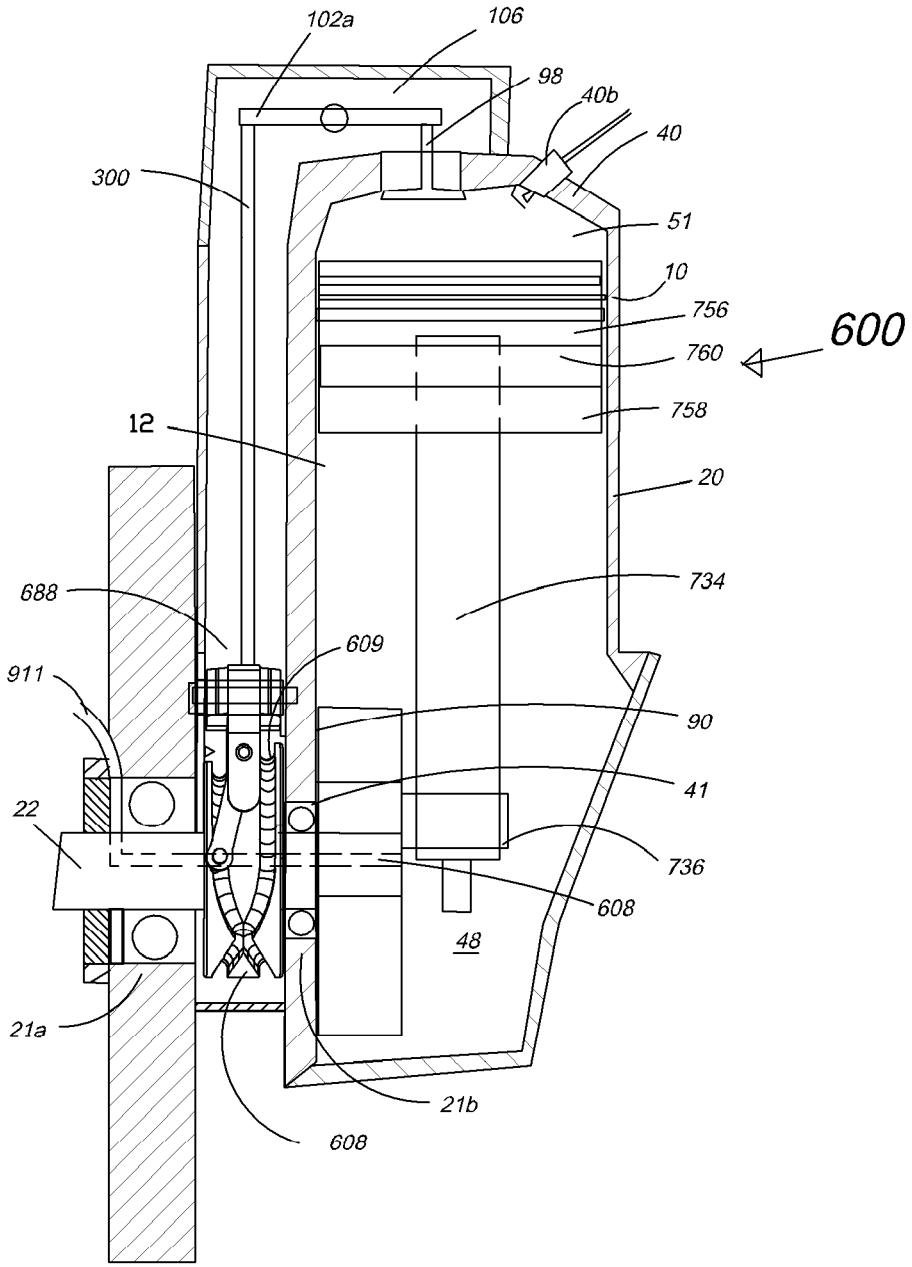
FIG. 6 is a cross-sectional view illustration of another embodiment of the mono-block four-stroke engine with a cam lobe between inner and the outer bearing bosses.

Illustrated in FIG. 6 is an alternative embodiment of the engine 600 that is similar in construction to the engine 1 in FIG. 1, except the engine 600 has cam lobe 608 mounted on the crankshaft and channels 609 in the cam lobe 608 similar to U.S. Pat. No. 7,000,581. The construction and functionality of the engine 600 is similar to the prior art. However, FIG. 6 shows where the cam lobe 608 is between the inner and the outer bearing bosses 21*b*, 21*a* respectively. As shown in FIG. 6, the engine 600 has push tube type valve train. A valve train chamber 688 is similar to valve train chamber 88 in engine 1 where the lower end of the chamber 88 may be open to the crankcase chamber 48 as shown in FIG. 5 or may be closed as shown in FIG. 1. The push tubes 300 are disposed in the valve train chamber 688 and operably associated and ridingly engaged with channels 609 in the cam lobes 608 mounted on the half crankshaft 22 between the inner and outer bearings 41, 28. The cam lobe 608, however, now rotates at the same speed as the crankshaft 22 as there are no reduction gears unlike a conventional four-stroke engine.

Figure 3:
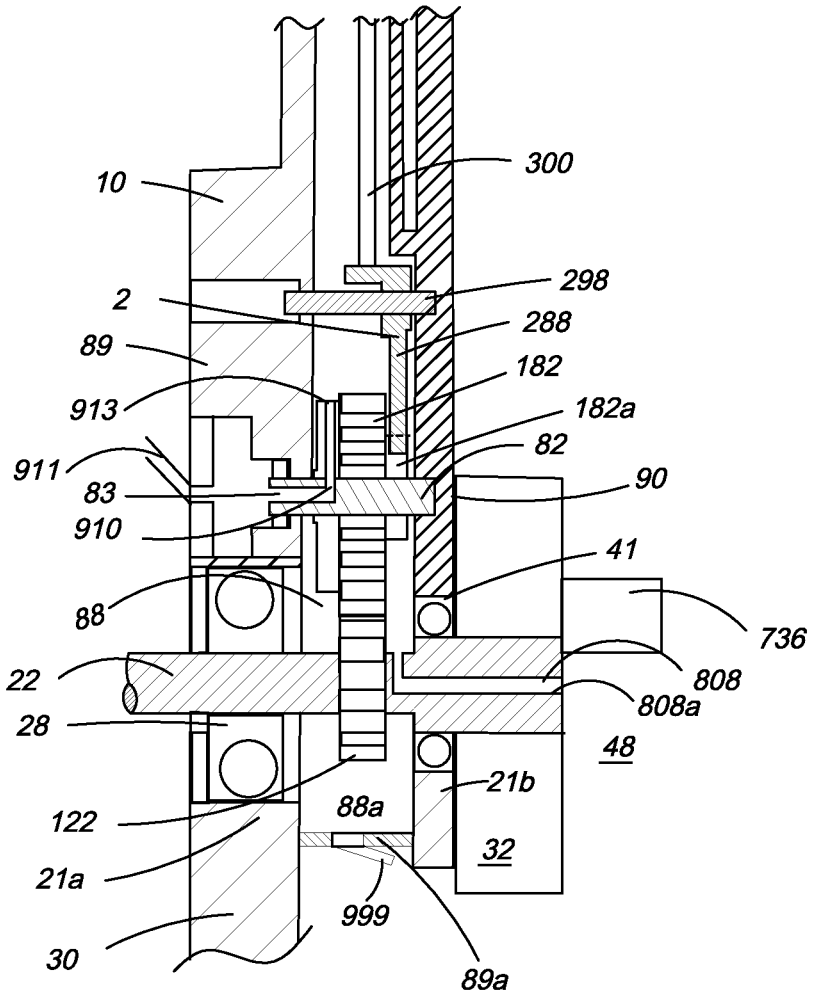
FIG. 3 is an enlarged cross-sectional front view illustration of a cam chamber with a breather passage in a cam shaft of the engine illustrated in FIG. 1.

FIG. 3 illustrates a cam assembly 182*a* including a cam shaft 82 and a cam gear 182. A breather system includes a breather passage 910 through the cam shaft 82 that connects a breather tube 911 to the ambient to a hole 913 to the inside of the engine to relive the crankcase chamber pressure built-up due to blow-by gases. The breather passage 910 and its function are similar to the expired U.S. Pat. No. 6,502,565.

Lubrication of the push tube valve train 2 is achieved by providing an oil passage 808 through the center of the crankshaft 22 that runs axially from the crankcase chamber 48 and then radially to the valve train chamber 88. Unlike breather passages disclosed in U.S. Pat. Nos. 6,039,020 and 6,047,678, the purpose is to supply a small amount of oil from the crankcase chamber into the valve train chamber 88, which in turn lubricates the valve train 2. The lower opening 88*a* is closed and there may be an oil seal in the inner bearing boss 21*b* or the inner bearing 41 could be a sealed bearing that prevents direct flow of oil from crankcase chamber into the valve train chamber 88.

The small amount of oil that gets on the cam gears 182 and the crank gear 122 is splashed to help lubricate the intake valves 98 and rockers 102*a*. Oil condensed in the valve train chamber 88 is returned to the crankcase chamber 48 through a check valve 999 on the cover 89*a*, which opens when the crankcase chamber pressure drops as the piston assembly 756 moves upward as illustrated in FIG. 9*b*. Other types of valves may be used. The opening 88*a* may be used for many purposes. One such use as described above is to have a check valve 999 disposed therein for return of oil from the valve train chamber 88 to crankcase chamber 48. It can have a oil pump 1505 disposed therein as illustrated in FIG. 12*b*, or a rotary valve between the valve train chamber 88 and crankcase chamber 48, or a rotary check valve for supply and or return of lubricating oil when a separate reservoir for oil is used. In conventional engines, oil that escapes through the breather passage is collected in a separation chamber (not shown) and then returned to the crankcase chamber through a check valve. The oil passage 808 through the crankshaft disclosed herein prevents oil from flowing into the valve train chamber 88 and subsequently into the breather or valve chamber 106 when the engine is stored in almost any attitude because the inlet 808*a* is always above the oil level.

Figure 2:
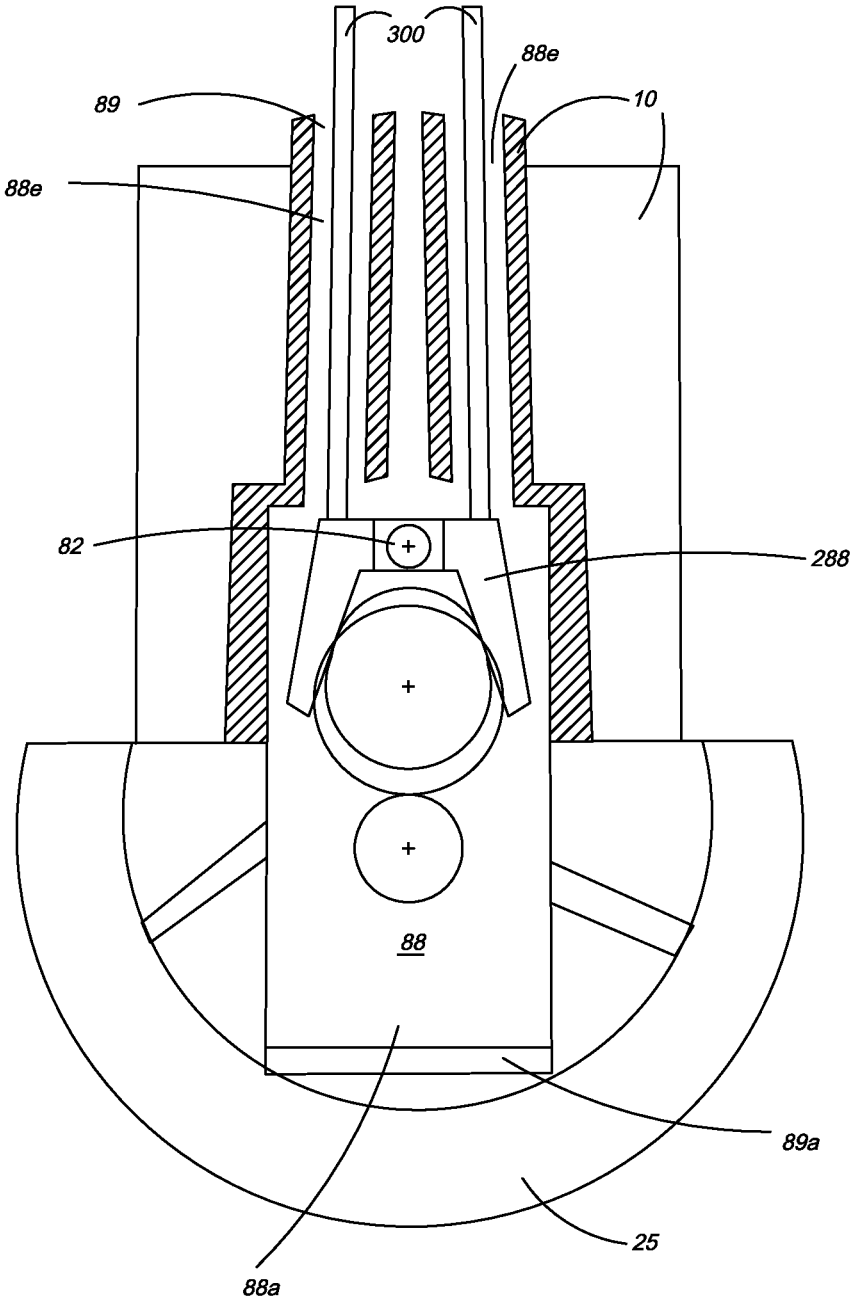
FIG. 2 is a cross-sectional front view illustration of the engine illustrated in FIG. 1.
Figure 7:
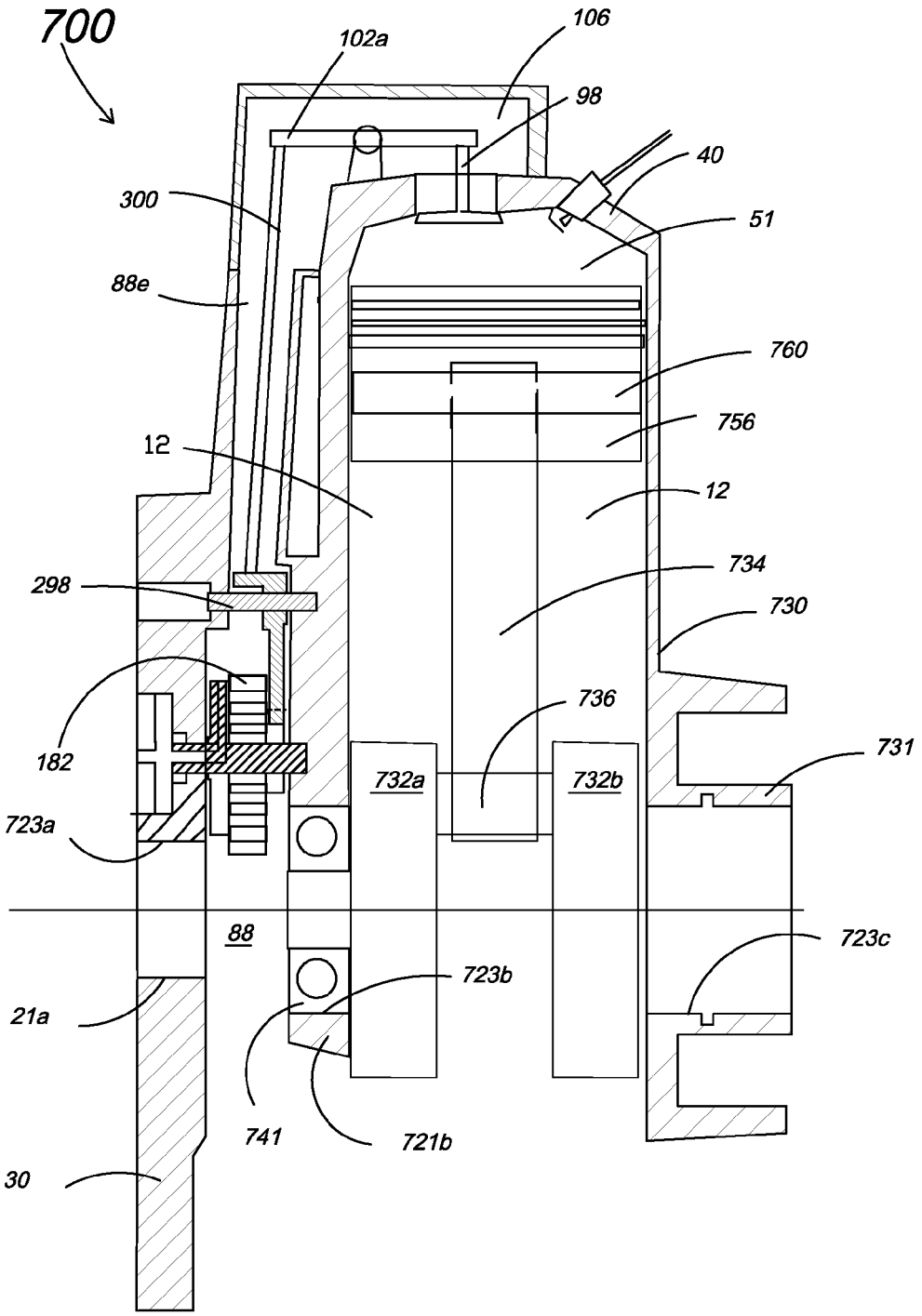
FIG. 7 is a cross-sectional view illustration of another embodiment of the mono-block four-stroke engine with a full crank and a single block to support the full crankshaft.
Figure 8:
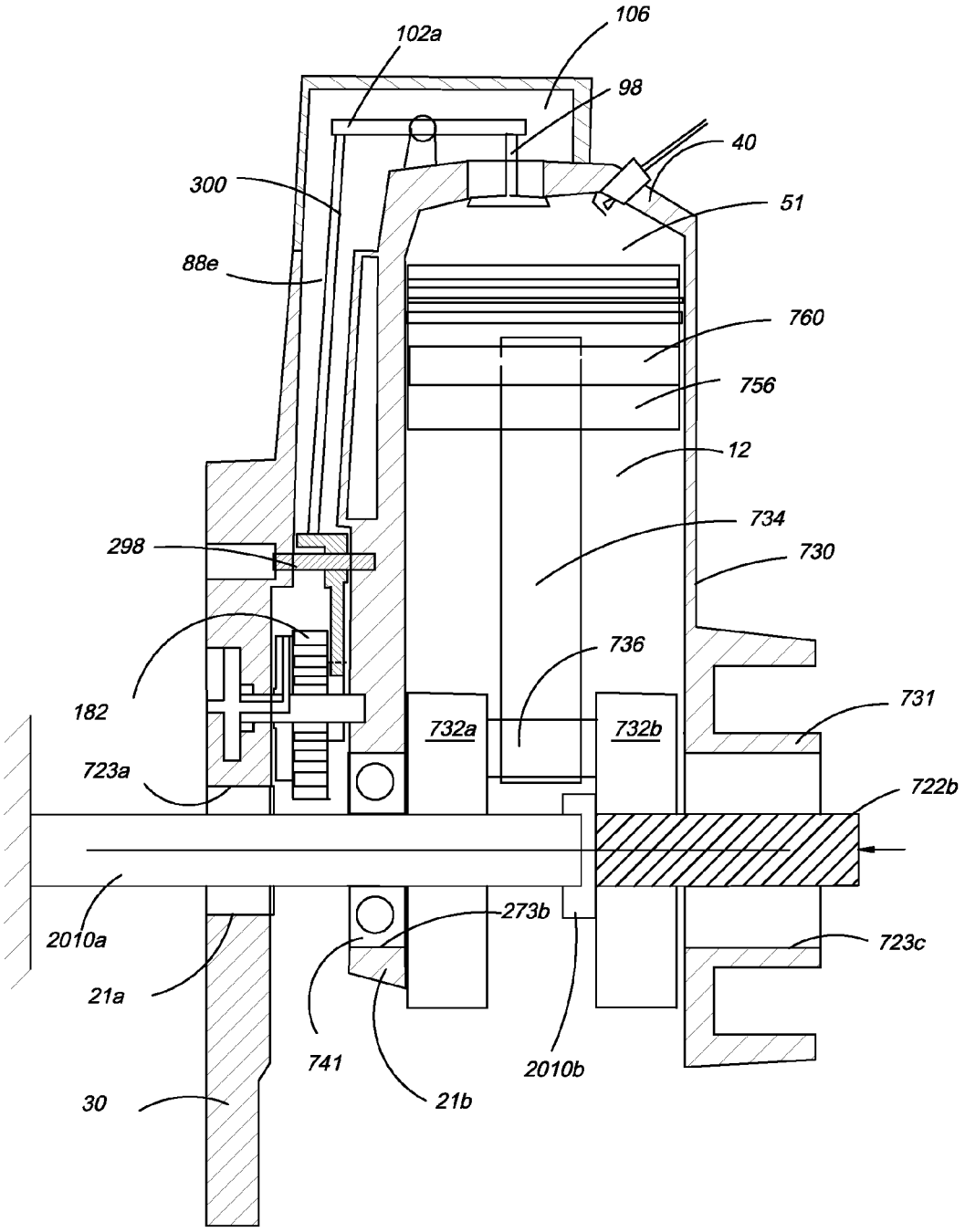
FIG. 8 is a cross-sectional view illustrating an outboard shaft being pressed into a counter-weight in the engine illustrated in FIG. 7.
Figure 9C:
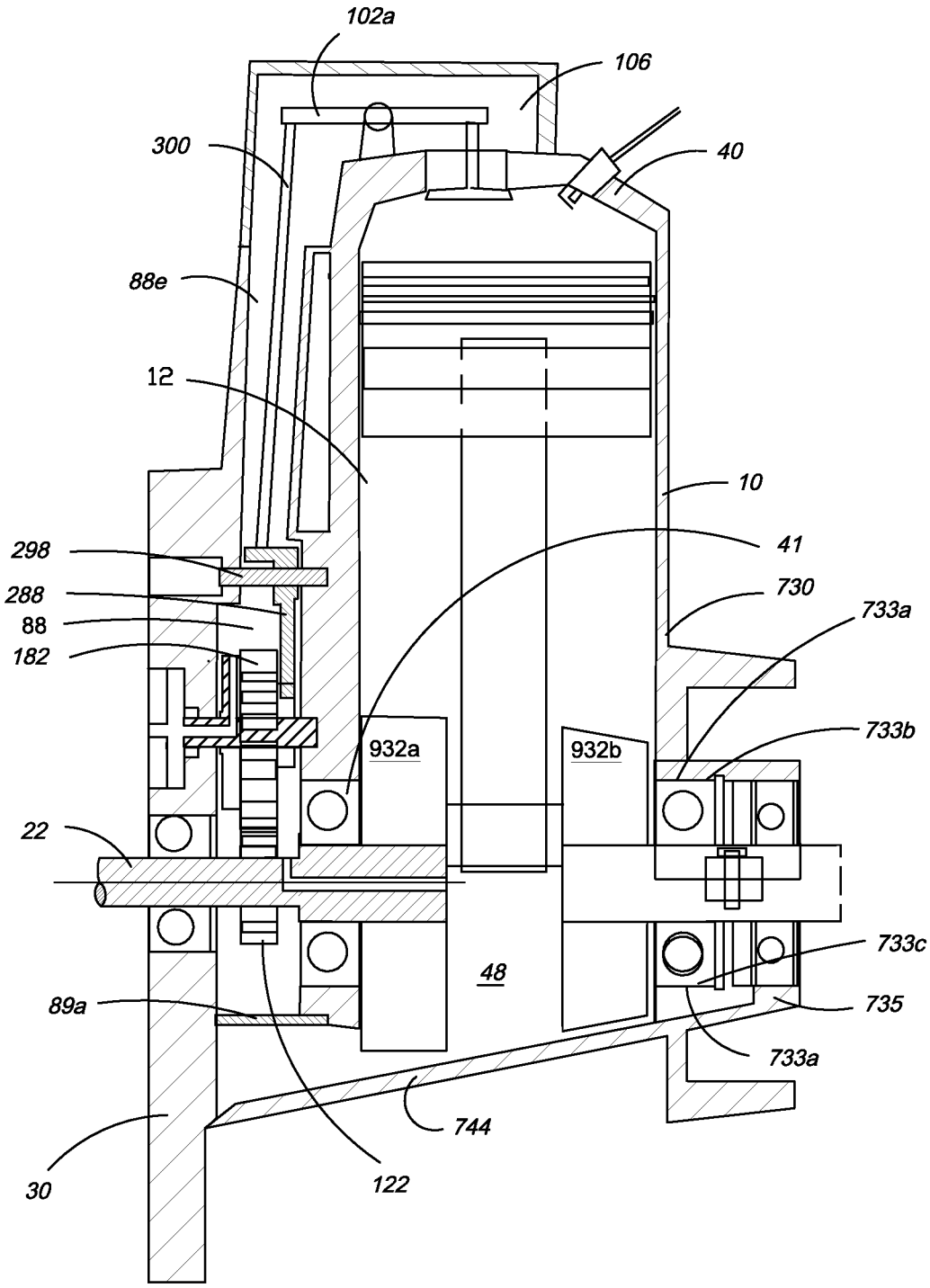
FIG. 9*c* is a cross-sectional side view illustration of another embodiment of the mono-block four-stroke engine with a half-crank and one half of the outboard bearing boss being integral with the cylinder block.

A full crank engine 700, illustrated in FIGS. 7-9, is similar in construction to engine 1, illustrated in FIGS. 1-3. The full crank engine 700 includes an outboard bearing boss 731 in an outboard crankcase wall extension 730 of the cylinder block 20. The crankcase 30 includes integrally cast crankcase outboard and inboard walls 89 and 90 which include first and second bearing bores 723*a* and 723*b* and are integrally cast with the cylinder block 20. The first and second bearing bores 723*a* and 723*b* and the outboard bearing boss 731 supports a full crankshaft 722 which includes inboard and outboard crankshaft halves 722*a* and 722*b*. In most conventional full crank engines, the crankcase is split into two crankcase halves either vertically in line with the central line of the cylinder bore 12 or at an angle as in U.S. Pat. Nos. 6,439,215 and 6,250,273 or horizontally along the axis of the crankshaft as in U.S. Pat. Nos. 6,332,440, 6,021,766, and 5,947,075. The disadvantage is that the two crankcase halves are first assembled together first in order to machine the bearing bore and then detached for final assembly. Typically, the two crankcase halves stay as pairs. The embodiment of the engine 700 shown in FIGS. 7-9 has a single cylinder block 20 to support the full crankshaft 722. First, second, and third bearing bores 723*a*, 723*b*, and 723*c* may be machined at the same time concentric to each other as well as perpendicular to the cylinder bore 12 and with better quality control. The alignment of the front and rear bearings are also better. Alternatively, an upper half 733*b* of an outboard bearing boss 733*a* may be integral with the cylinder block 20 while a lower half 733*c* of the outboard bearing boss 733*a* may be part of the crankcase cover 744 as illustrated in FIG. 9*c*.

Assembly of the inboard and outboard crankshaft halves 722*a*, 722*b* will be different than the conventional methods. A method of assembling the cam shaft 82, cam gear 182, and the followers 288, as illustrated in FIGS. 1 and 3, includes pressing the cam shaft 82 into the cylinder block 20 through a hole 83. The cam shaft 82 may be free to rotate in the hole 83 in the cylinder block 20 when the cam shaft 82 is pressed into the cam gear 182 and the lobe 108. Alternatively, the cam shaft 82 may have an interference fit within the hole 83 in the cylinder block 20 while the cam gear 182 and the lobe 108 are rotating on the cam shaft 82.

Figure 11:
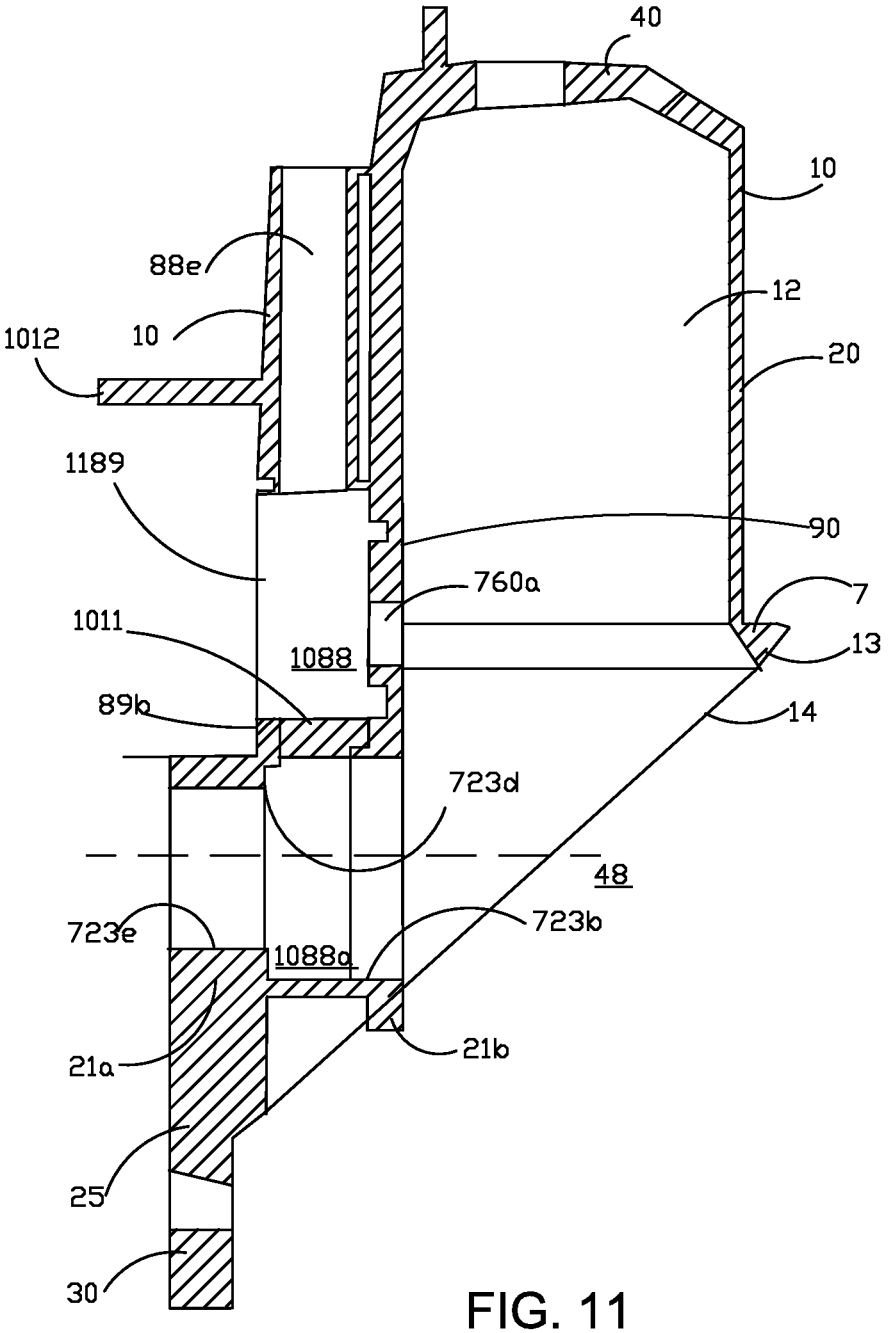
FIG. 11 is a cross-sectional side view illustration of a front part of a cam chamber closed with separate cam cover.

A method of assembling the full crank engine 700 with integral bearing bosses includes assembling first and second counter-weights 732*a*, 732*b*, installing crank pin 736 through the first and second counter-weights 732*a*, 732*b*, connecting rod 734, as illustrated in FIG. 9. The second counter-weight 732*b* may be just a yoke for an outboard starter in case of a simulated full crank. The counter-weight assembly procedure may also include installing the piston pin 760 through the piston assembly 756 and the connecting rod 734 of the piston assembly 756. However, it is also possible to assemble the piston assembly 756 separately to the connecting rod 734 after the crankshaft has been installed. It is done by inserting the piston pin 760 through a hole placed in the cylinder block 20 as done in the case of some Briggs and Stratton engines. Alternatively, as illustrated in FIG. 11, the hole 760*a* in the cylinder block 20 for inserting the piston pin 760 may be located in the valve train chamber 88.

Referring to FIG. 7, step 1 of the method for assembling the full crankshaft 722 includes, with an inner bearing 741 already pressed into the bearing boss 721*b*, inserting the piston assembly 756 and the connecting rod 734 into the cylinder bore 12. Then aligning the first and second counter-weights 732*a* and 732*b* correctly with respect to the bearing bores 723*a*, 723*b*, and 723*c*.

Referring to FIG. 8, step 2 of the method includes pressing the outboard crankshaft halves 722*b* into the counter-weight 732*b* while the counter-weight 732*b* is supported by the tools 2010*a* and 2010*b*. The tool 2010*a* passes loosely through the inner bearing 741.

Referring to FIG. 9, step 3 of the method includes supporting the outboard crankshaft halves 722*b* with a special tool 2020*a* that passes around the outboard crankshaft halves 722*b* and through the bearing bore 723*c* in the outboard bearing boss 733*a*, supporting the first counter-weight 732*a* with a special tools 2020*b*, and pressing the inboard crankshaft halves 722*a* into the counter-weight 32.

Referring to FIG. 9*b*, step 4 of the method includes pressing first and third oil seals 928*a*, 928*b* into the first and third bearing bores 723*a* and 723*c*.

Step 5 of the method includes inserting the outboard bearing 731 (or bearings for outboard starter) and oil seals 728*b*. The outboard bearing may either slide fit on the outboard crankshaft halves 722*b* and may be secured in place with the circlip.

It should be noted that the oil seal or oil seals may be used in conjunction with the bearings at any bearing bosses 21*a*, 21*b* and 731 as necessary depending on lubrication systems and breather systems.

Referring to FIGS. 9 and 9*b*, installation of the outboard crankshaft halves 722*b* in case of a half-crank with outboard starter is a lot easier because the yoke is not rigidly pressed onto the crank pin 736. In this case, the outboard bearing boss may be just top half integral with the cylinder block, while the lower half is part of the crankcase cover 744 as shown in FIG. 9*c*. However, the outer edge of the boss 735, shown in FIG. 9*c* is still integral with the cylinder block. This helps to improve sealing of crankcase cover 744 with the mono-block 10.

FIG. 9*b* illustrates the assembled engine with a separate oil chamber 948*b* attached to the bottom of the crankcase cover 944*a* with a slot 964 for the slinger 934*b* on the connecting rod 934 to splash the oil. It may be noticed that when the engine is turned upside down, the oil does not poor down into the crankcase chamber 948*a* because of a separation wall 966. However, the bleed passage 952 allows a small amount of oil to drip onto the first and second counter-weights 932*a*, 932*b* so the piston assembly 756 gets lubricated and also some oil goes into the valve train chamber 88 for lubricating the valve train. It is possible to time the opening of the bleed passage 952 with the counter-weight 932*a* so that the bleed passage 952 is open when the piston assembly 756 moves upward causing negative pressure in crankcase chamber 948*a* and close it when the piston is in downward motion causing positive pressure in the crankcase chamber 948*a*. The oil condensed in the valve train chamber 88 and valve chamber 106 is returned to the crankcase chamber 948*a* or possibly directly back into the separate oil chamber 948*b* through a check valve 999 illustrated in FIG. 9*b*. It is also possible to drain the oil from the valve chamber 106 into the oil chamber through an additional return passage and check valve, particularly, when the engine is run upside down.

Figure 10:
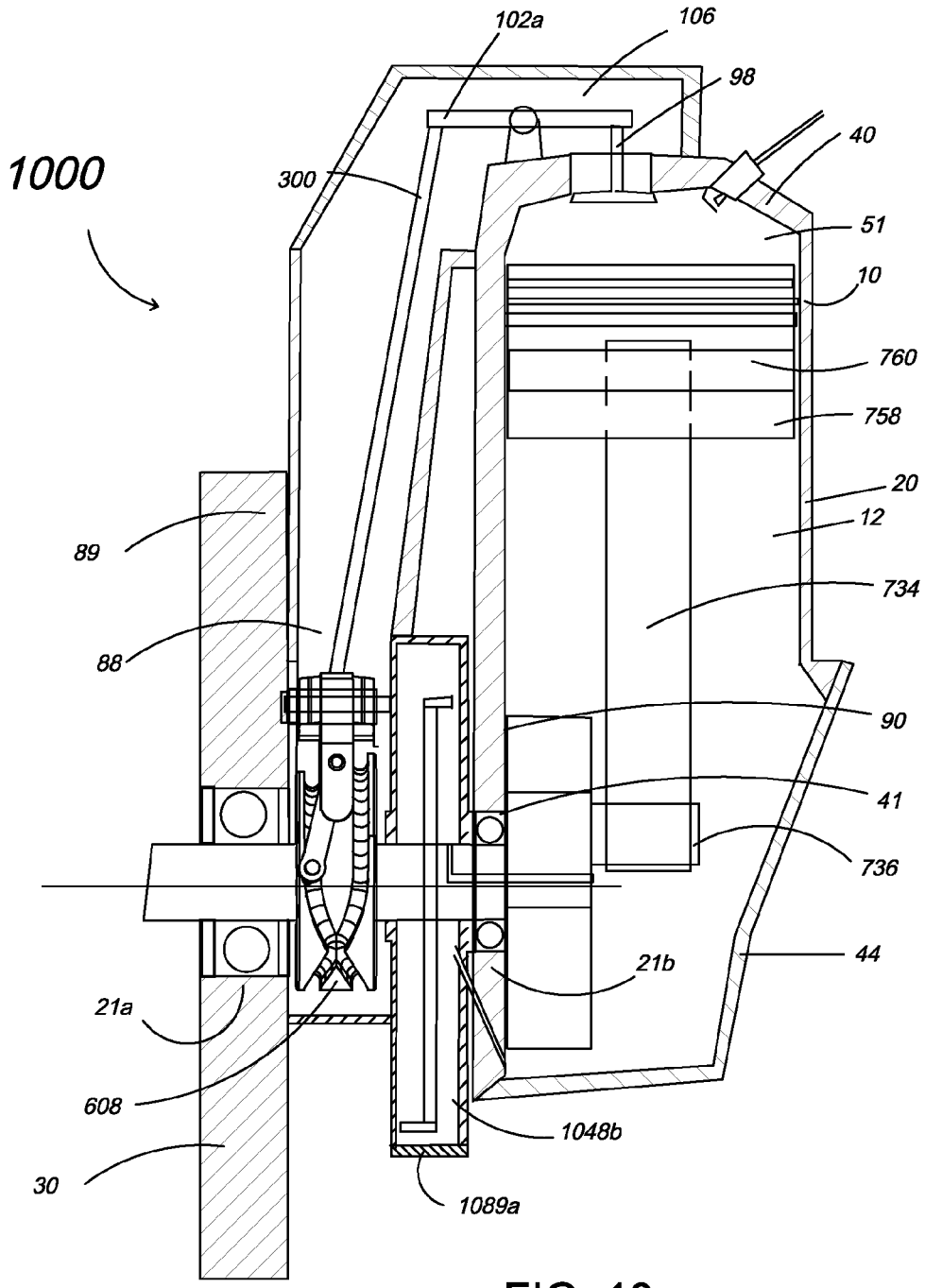
FIG. 10 is a cross-sectional side view illustration of another embodiment of the mono-block four-stroke engine with a separate oil chamber with an oil slinger attached to the crankshaft.

In another embodiment of the engine, illustrated in FIG. 10, the oil chamber 1048*b* may be a separate chamber similar to the dry sump lubrication system described in Honda's U.S. Pat. Nos. 5,947,075 and 6,021,766, etc. The disadvantage with Honda's design is that the crankcase consists of two separate halves that have to be machined first and the two pair have to stay together during production and is not a cost effective design. Honda's two patents disclose full crank engines while the engine disclosed herein is a half-crank engine. As illustrated in FIG. 10, the oil chamber 1048*a* can be molded such that the entire chamber is an integral part of the cylinder block 1000 as shown in FIG. 10. The casting, machining and assembly are much simpler. The bottom of the oil chamber is easily plugged with a cover 1089*a*.

Figure 11B:
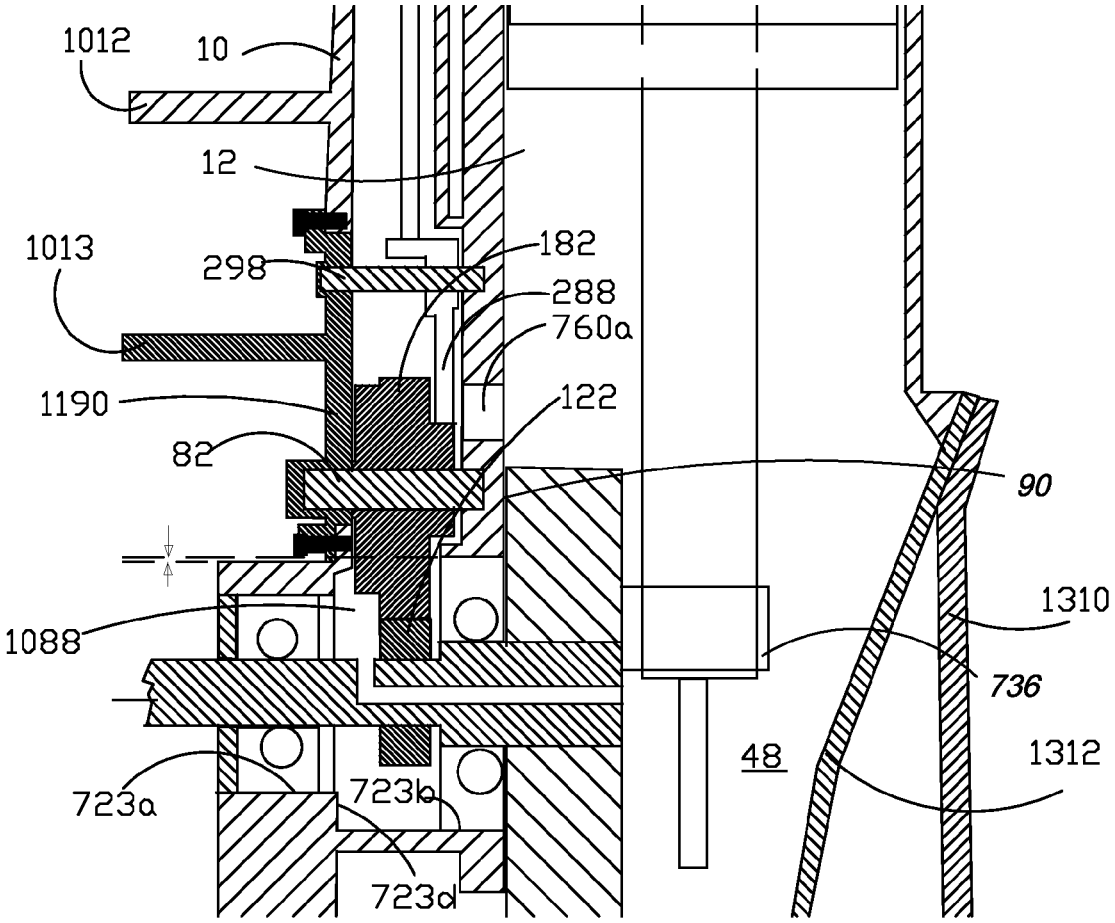
FIG. 11*b* is a cross-sectional view of mono-block four-stroke engine with cam cover and integral boss for mounting the ignition module.

FIGS. 11 and 11*b* illustrate the second bearing bore 723*b* (an inner bearing bore) as being bored all the way to the inside wall 723*d* of an outer bearing bore 723*e*. The leftover material 1011 is then machined out to form valve train chamber 1088. In this case, the lower end 1088*a* of the valve train chamber 1088 is closed and there is no need for any kind of plug. However, the front face 1189 of the valve train chamber 1088 has to be cored out from the front for inserting the cam shaft 82, cam gear 182 and followers 288 with the follower pin 298. This calls for a separate cam cover 1190 as illustrated in FIG. 11*b*. FIG. 11*b* illustrates how the front part of the valve train chamber 88 may be closed with separate cam cover 1190 and one of the bosses for the cam shaft 82 and follower pin 298 may be on the cam cover 1190. Inner and outer ignition bosses 1013 and 1012 are for mounting an ignition module (not shown) for providing voltage for the spark. The outer ignition boss 1012 is integral to the cylinder block 20.

FIGS. 12 and 12*b* illustrate another embodiment of the engine 1200 having a wet belt drive, similar to what is described in the Honda prior art. An overhead cam pulley 1282 running at half the engine speed is driven by a timing belt 1284 and a crank pulley 1286 on the crankshaft 1222. The crank pulley 1286 may be either in a separate chamber 1288 adjacent to the oil chamber 1248*b* with an oil seal between the two chambers or the valve train and oil chambers 1288 and 1248*b* may be commonly cored out from the bottom. The slingers 1234*b* are attached to the crankshaft 1222. There may be more than one pair of slingers. A belt drive passage 1288*e* is cored out from bottom as well as top of the cylinder block 1210. A follower 102*b* and a rocker 102*a* shown in FIG. 12 represents the valve train. It is well known how to operate the intake valve 98 and the exhaust valve 99 with the overhead cam 1208. FIG. 12*b* illustrates a lubricating oil injection pump 1505 attached to the cylinder block 20 and driven by the crankshaft 1222 through a worm gear 1502 and a gear 1503. The pump may also be driven off of a cam shaft 82 such as the one illustrated in FIG. 5*b* through reduction gear in the oil pump. The pump 1505 has an inlet 1507 to receive oil from an oil reservoir and an outlet 1509 to deliver oil to the first intake passage 126*a* as shown in FIG. 14*d* or into the crankcase chamber 48. The oil injection system may use a pressure sensor 1513 (or oil level sensor in the oil reservoir) to kill the engine when oil pressure in the outlet 1509 (or oil level in reservoir) falls below a predetermined value to prevent the engine from seizure. The air-fuel mixture may be supplied into the crankcase chamber 48 through a port 84 in the cylinder block 20 by a carburetor 500. The oil pump may be used for oil circulation in the engine as in a conventional internal combustion engine.

Mist lubrication in a two-stroke engine is commonly used. The oil is pre-mixed with the fuel and in some cases the oil is injected into the engine using a crankshaft driven oil pump similar to the one shown in FIG. 12*b*.

Figure 13:
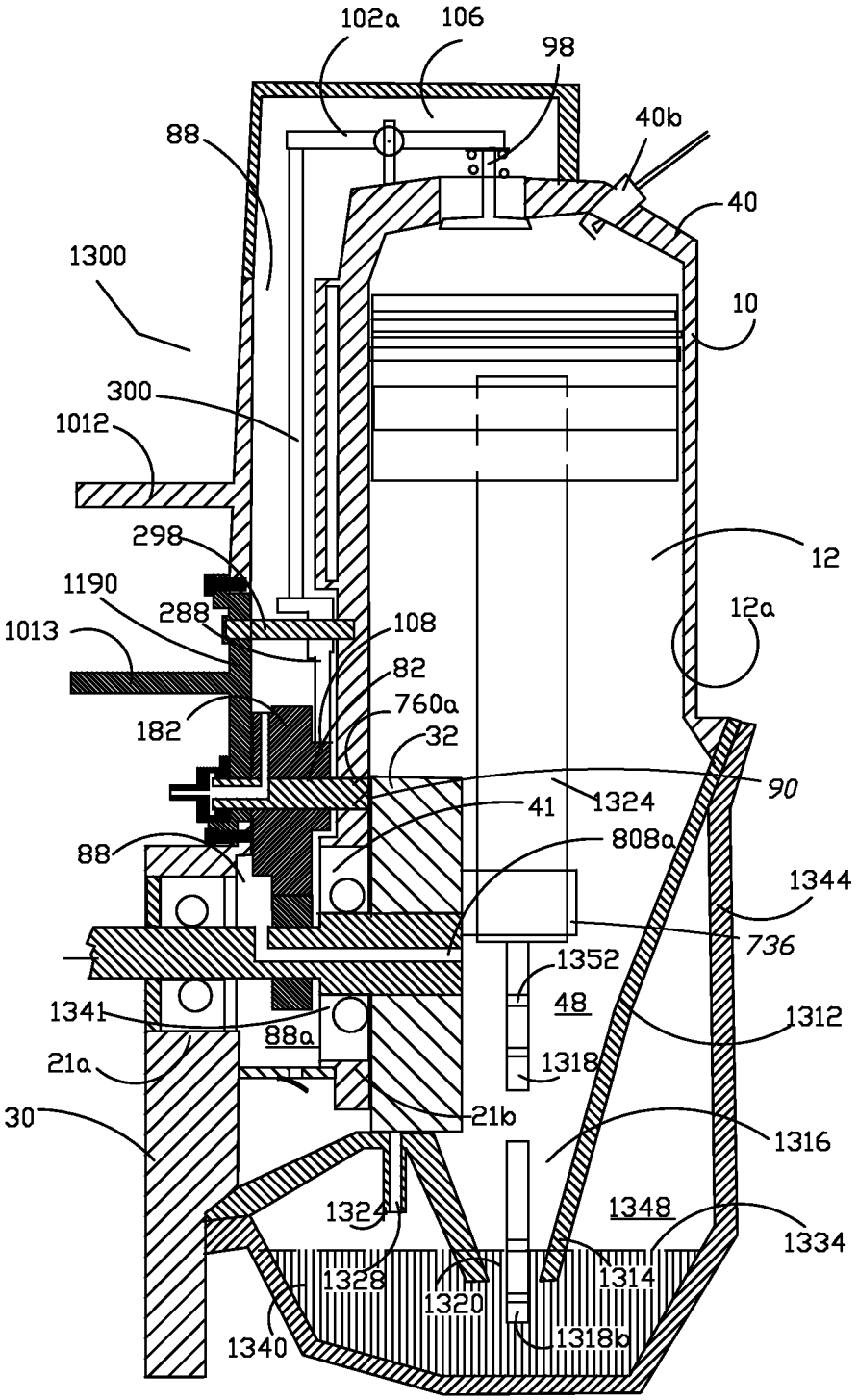
FIG. 13 is a cross-sectional side view illustration of a half-crank embodiment of the mono-block four-stroke engine illustrated in FIG. 9*b*.
Figure 13B:
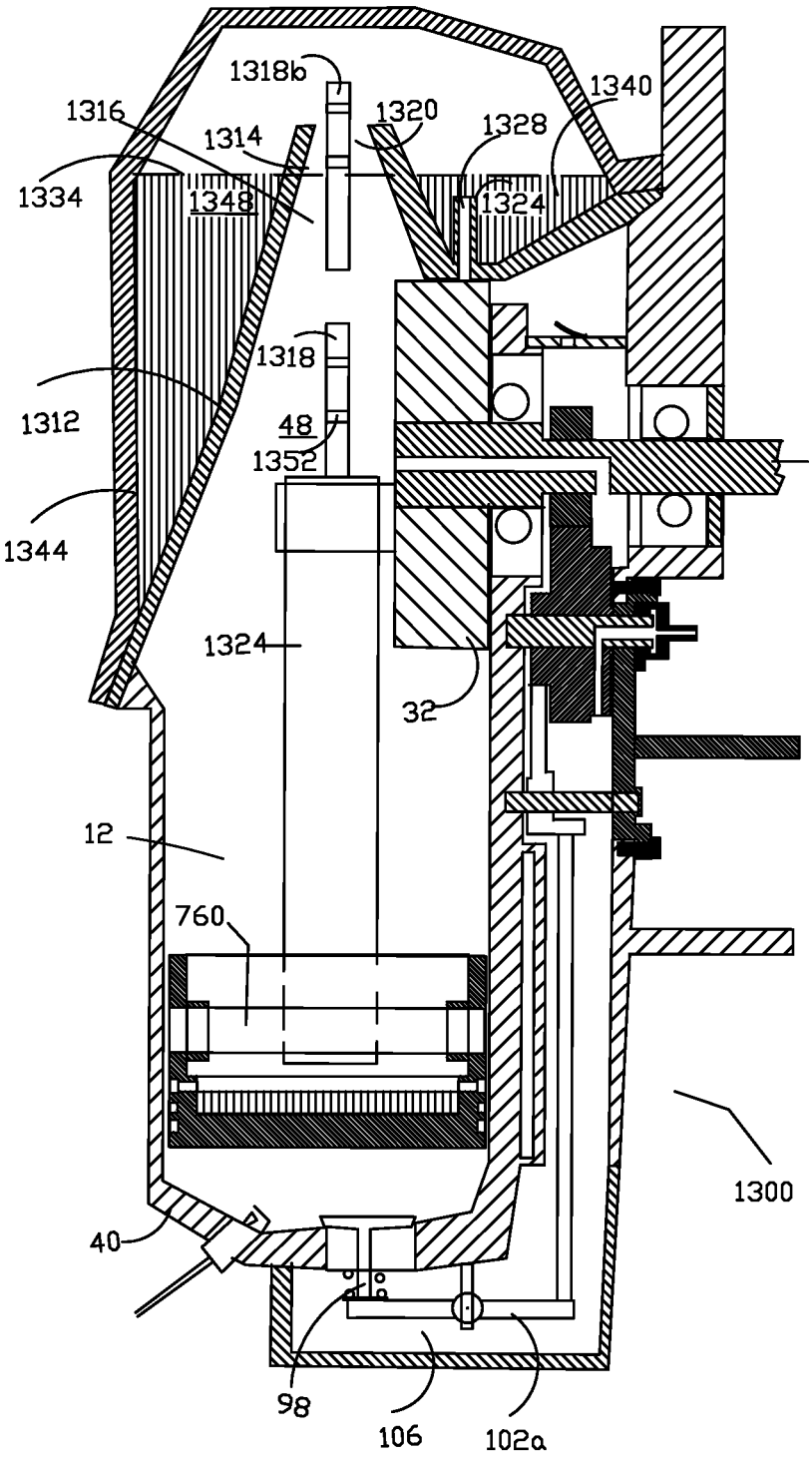
FIG. 13*b* is a cross-sectional side view illustration of the engine in FIG. 13 in an upside down attitude.
Figure 13C:
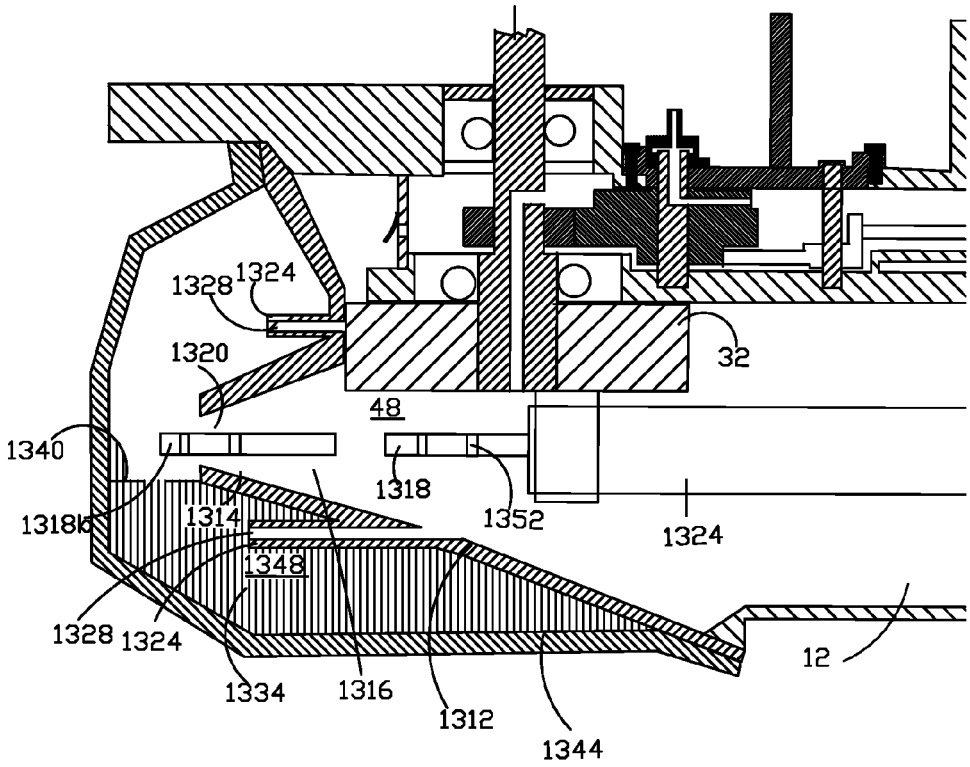
FIG. 13*c* is a cross-sectional side view illustration of the engine in FIG. 13 in a horizontal attitude.

FIGS. 13 and 13*b* illustrate an alternative embodiment of the half-crank engine illustrated in FIG. 9*b*, which prevents oil 1340 from getting into the cylinder head 40 when engine 1300 is upside down or sideways. A slinger 1318 reciprocates in and out of a slinger tube 1320 protruding from a crankcase cover 1312 into the oil sump 1348 disposed between the crankcase cover 1312 and a sump wall 1344 separating the crankcase chamber 48 and the oil sump 1348. A slinger innermost position 1318*b* further illustrates reciprocation in to the tube 1320. As the connecting rod slinger 1318 moves, the oil in the oil sump is splashed into the inside of the crankcase chamber 48 so that the oil hits a cylinder wall 12*a*, and moving parts such that they are all lubricated. The oil droplets (or mist) are also carried to lubricate the valve train, which includes a cam 108, a cam gear 182, followers 288 and other parts such as rockers, etc. The oil mist or droplets may be carried into the cam chamber 88 and the valve chamber 106 through a passage 808*a* in the crankshaft 1222 or alternatively through bearing passages 1341 in an inner bearing 41. An oil level 1334 is illustrated in FIG. 13 when the engine 1300 is in an upright position. When the engine is turned sideways or upside down, as illustrated in FIG. 13*b*, the oil in the oil sump does not spill into the cylinder bore or crankcase chamber, instead oil may drip into the crankcase chamber 48 through oil passage(s) 1328 in a standoff tube 1324 protruding from the crankcase cover 1312 into the oil sump 1348. There may be more than one such standoff tube, such that the engine is lubricated in all attitudes. Elements 1352 are serrations on the slinger or scoops or any similar devices to help splash oil into the crankcase chamber 48. The oil supply passages to the cylinder head and returns may be located in the crankcase chamber such that excessive oil does not get to the head. Alternatively, the slinger 1318 may be located inside a pocket 1316 protruding into the oil sump 1348 which is disposed between a crankcase cover 1312 and a pocket wall 1314 separating the crankcase chamber 48 and the oil sump 1348 as illustrated in FIG. 13. A front part of the valve train chamber 88 may be closed with separate cam cover 1190 and one of the bosses for the camshaft 82 and follower pin 298 may be on the cam cover 1190. Inner and outer ignition bosses 1013 and 1012 are for mounting an ignition module (not shown) for providing voltage for the spark. The outer ignition boss 1012 is integral to the cylinder block 10.

Figure 14:
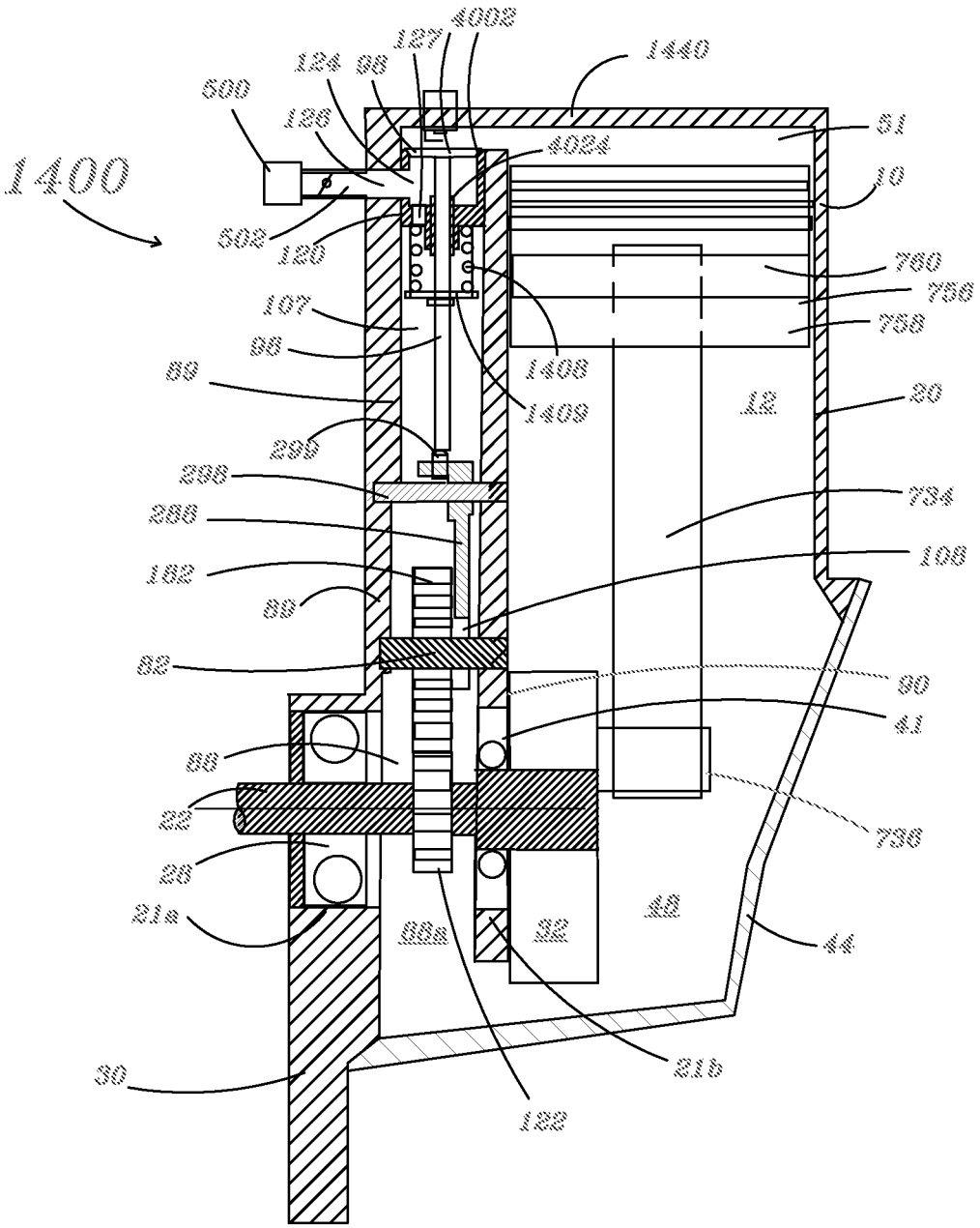
FIG. 14 is a cross-sectional side view illustration of an exemplary embodiment of a half-crank mono-block four-stroke engine with a L-head and a valve train.
Figure 14B:
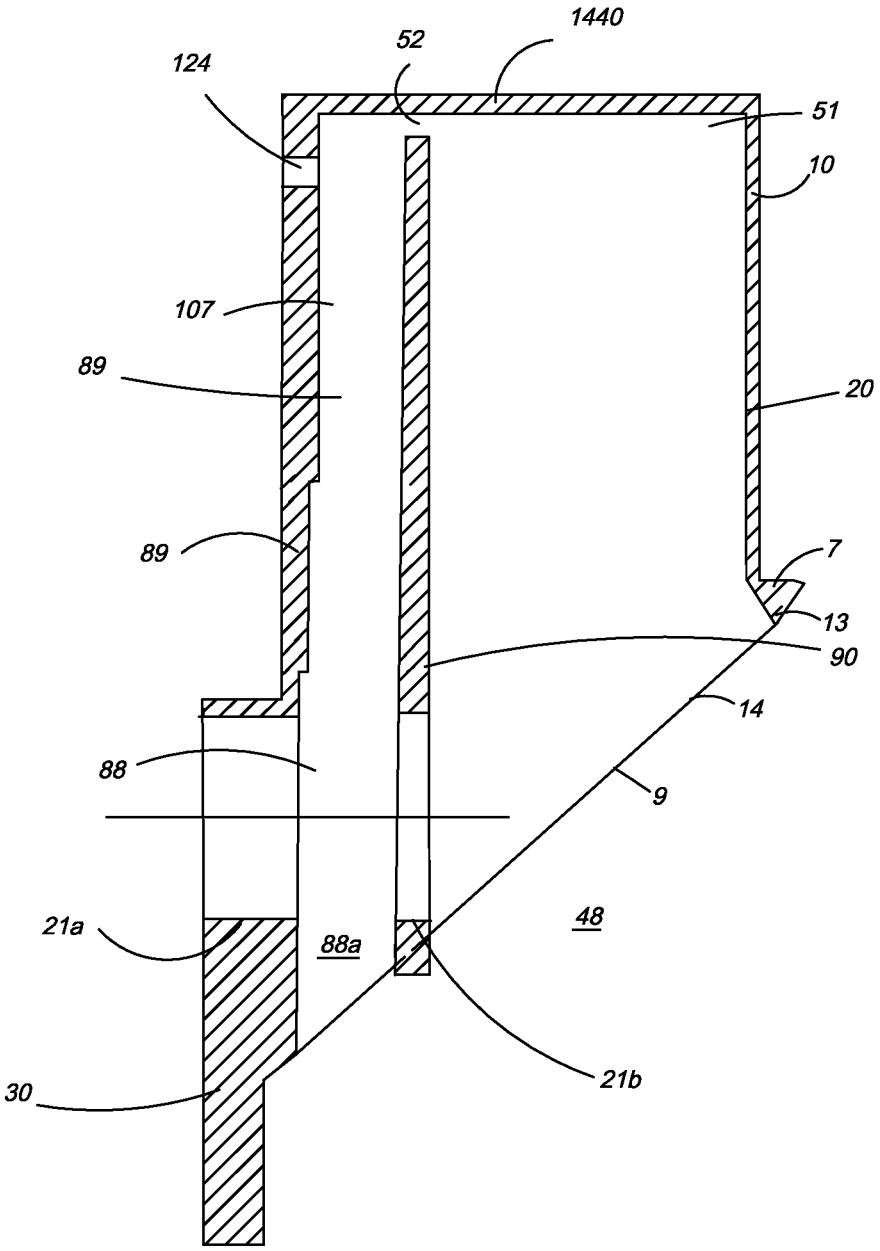
FIG. 14*b* is a cross-sectional side view illustration of a mono-block having integrally cast cylinder block, crankcase, cylinder head, outer and inner bearing bosses in the engine illustrated in FIG. 14.
Figure 14C:
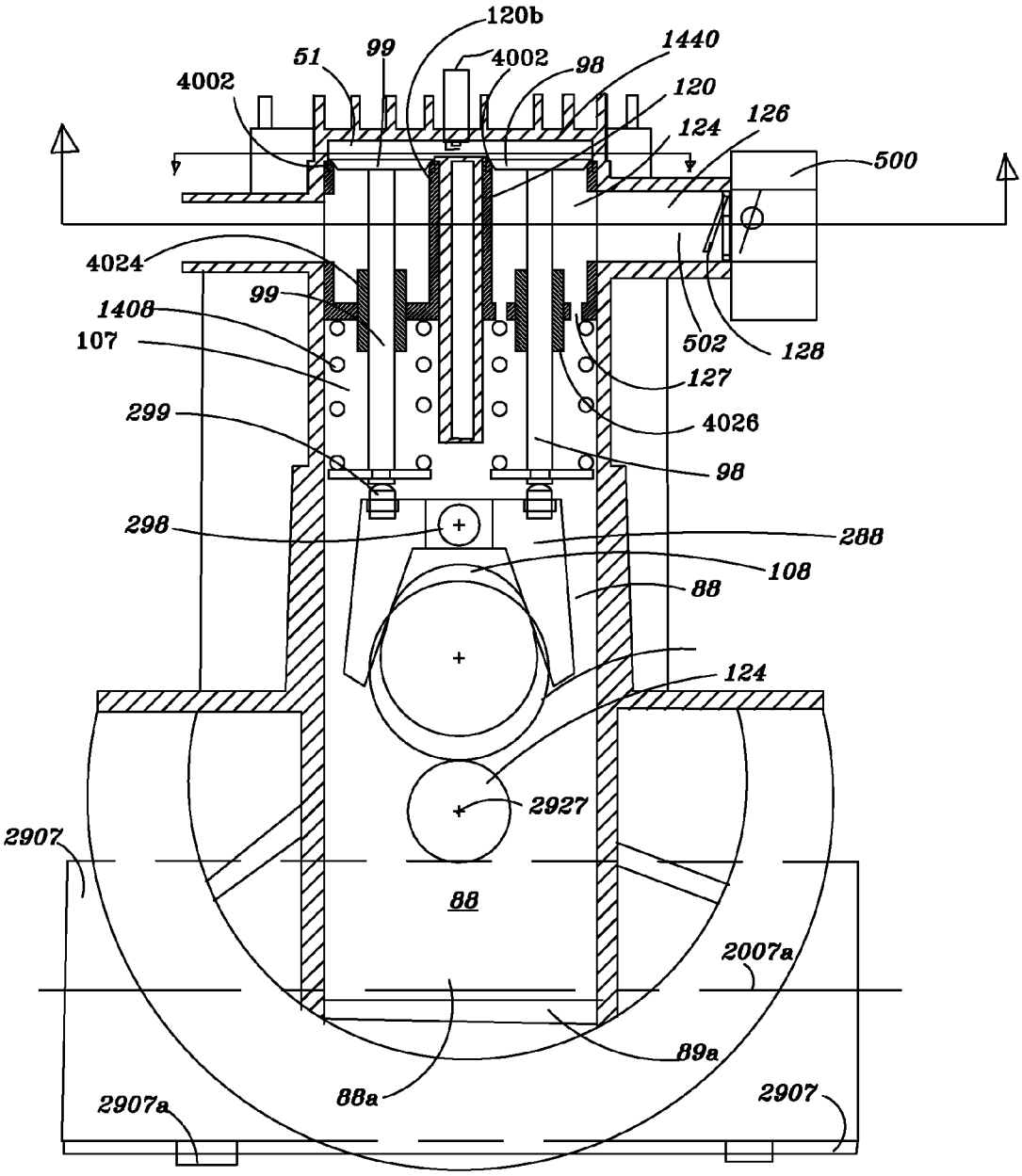
FIG. 14*c* is a cross-sectional front view illustration of another embodiment of a mono-block having integrally cast cylinder block, crankcase, cylinder head, outer and inner bearing bosses, valve assembly on the side of the cylinder block in the engine illustrated in FIG. 14, and an intake system with one way valve in the intake passage.
Figure 14D:
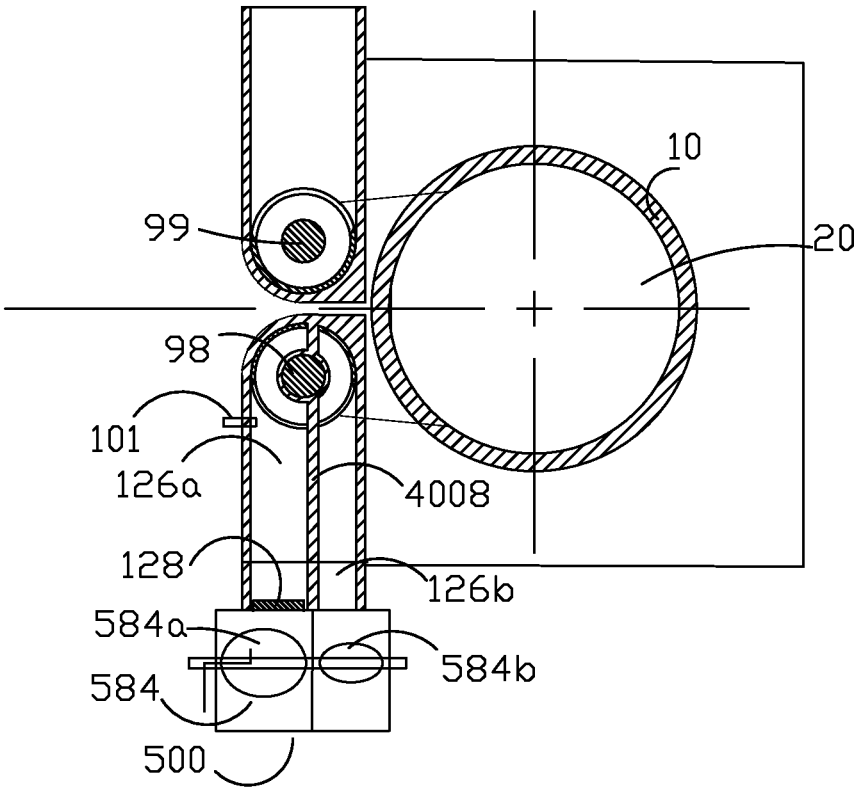
FIG. 14*d* is a cross-sectional top view illustration of another embodiment of an engine with a divided intake system with one way valve in one intake passage and oil injection into said passage.

FIGS. 14, 14*b*, 14*c*, 14*d*, 14*e*, and 14*f* illustrate another embodiment of the engine 1400 having an integral L-head mono-block 10 including an integral (one piece) cylinder block 20, an L-head 1440, and crankcase 30. A cylinder bore 12 is disposed within the cylinder block 20 and a valve train chamber 88 is disposed between the cylinder block 20 and an outboard wall 89 integrally cast with the cylinder block 20 as part of the mono-block 10. The integral casting of the mono-block 10 is illustrated in FIG. 14*b*. The L-head 1440 covers the valve train chamber 88 and the cylinder bore 12 disposed within the cylinder block 20 and spaced apart from inboard wall 90. An L-head valve chamber 107 in the valve train chamber 88, the valve train chamber 88, and the crankcase chamber 48 are all interconnected through passages and disposed between the cylinder block 20 and at the bottom of the valve train chamber 88 and the passage 52 at the top adjacent to the combustion chamber 51. The chamber 88 and valve chamber 107 are substantially in line with each other. Valve chamber 107 is substantially in line with the axis of the cylinder. However, it may also be at an angle to the axis of the cylinder.

The L-head valve chamber 107 has an intake valve assembly 120 for intake and an exhaust valve assembly 120*b* for exhaust that includes an intake valve seat 4002 and an intake valve guide 4024 for intake and an exhaust valve guide 4026 for exhaust. The valve chamber 107 further includes a valve spring 1408, and valve retainer 1409 and is tightly attached to the mono-block 10 in the valve chamber 107 between the chamber 88 and the combustion chamber 51, to form a leak proof combustion chamber 51. The valve assembly may be a modular piece where valve seat 4002, valve guide 4024, valve spring 1408, and valve retainer 1409 are all assembled separately prior to attaching to the mono-block 10. Valve lash is adjusted with a nut 299. The valve assembly 120 has an opening 124 to the ambient through an inlet port 126 connecting a carburetor 500 (fuel-air mixer). The valve assembly 120 can have an opening 124 connecting the carburetor 500 to the crankcase chamber 48 where the air-fuel mixture is mixed with lubricant oil. A passage 502 connecting the carburetor 500 and the crankcase chamber 48, through a connecting passage 127 in the intake valve assembly 120, may have a one-way valve 128 illustrated in FIG. 14*c* to prevent flow back through the carburetor 500 into ambient which prevents a charge from flowing back into the ambient when the piston is moving downward. By definition, charge means mixture of fuel and air and pre-mixed fuel or charge means fuel pre-mixed with oil.

Figure 14E:
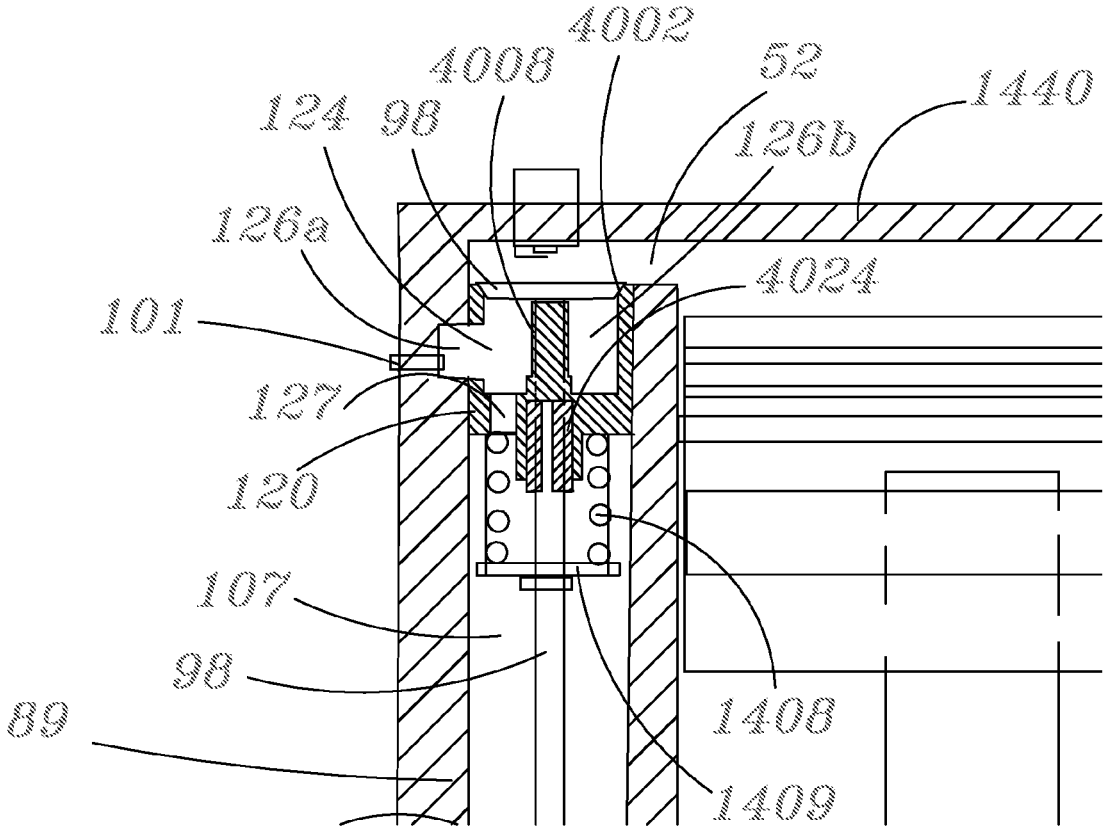
FIG. 14*e* is an enlarged cross-sectional view illustration of engine illustrated in FIG. 14*d* showing partition on intake system at the intake.

In another embodiment of the L-head engine 1400 having an integral L-head mono-block 10 illustrated in FIGS. 14*d* and 14*e*, the intake valve assembly 120 includes a dual intake passage 126 having first and second intake passages 126*a*, 126*b* that connects carburetor 500 directly to the cylinder bore 12 (combustion chamber 51) during the intake process and that connects the carburetor 500 to the crankcase chamber 48 through the connecting passage 127 through the intake valve assembly 120 during the exhaust or compression strokes which are both upward strokes. A partition wall 4008 runs all the way across the intake passage separating the flow all the way from the carburetor 500 to the intake valve 98 and across to minimize short circuit of the two mixtures until just before they enter the cylinder bore 12. A fraction of the charge 25% to 75% goes into the crankcase chamber 48 through the first intake passage 126*a* (or may have separate passage, not shown) when the piston is moving upward during compression and exhaust strokes and the piston is moving toward the combustion chamber 51. The dual intake passages 126*a*, 126*b* are connected from the carburetor 500 to the cylinder bore 12 when the intake valve 98 is open during intake stroke. The fraction of the pre-mixed charge goes into the crankcase chamber 48 to lubricate the engine parts, particularly, the valve train and parts in the crankcase chamber 48. It is also possible to inject lubricating oil separately into the first and second inlet passages 126*a* and 126*b* with an injector or injecting tube 101 when the fuel is not pre-mixed with oil. In which case, rich charge free of oil goes into the combustion chamber 51 and oil mixed charge (or oil mixed with just air) goes into the crankcase chamber 48. Amount of charge is controlled by the carburetor valve 584 and may have separate first and second valves 584*a*, 584*b* to regulate the mass flow into the first and second intake passages 126*a*, 126*b* respectively. When oil is injected into the passage 126*a*, only air may be inducted through the passage 126*a*.

Essentially, the divided inlet port 126 may have either only air going into crankcase chamber 48 through passage 126*a* when oil is injected into the air stream to lubricate the parts, or may have air-fuel mixture when oil is pre-mixed with the fuel, or may have lean air-fuel mixture free of oil when oil is injected into the lean mixture in passage 126*a*, while rich mixture flows through the passage 126*b* or the mixture may be of uniform air-fuel ratio going through both the passages 126*a*, 126*b*. Also, when only air passes through passage 126*a*, fuel supplied through passage 126*b* may be a propane fuel or any gaseous fuel, such as compressed natural gas, bio gas, etc.

The advantage of injecting oil into air inducted into crankcase chamber is that the fuel either liquid form as in the case of gasoline or gaseous as in the case of propane can flow directly into the combustion chamber during the intake process, while oil injected into air lubricates the valve train (cam gear, crank gear, followers, valves, cam lobe, etc) and bearings in the crankcase chamber 48 when the engine is a dry sump type without oil in the crankcase chamber 48.

Another advantage is that the engine can be operated in many attitudes as there is no oil in the crankcase chamber that would flow into the cylinder when engine is operated upside down. The dual intake system where port inlet 126 is divided into two separate passages 126*a*, 126*b* may also be applied to overhead valve chamber 107 shown in FIG. 1, but with a passage 126*a* connecting the valve chamber 107 and only air entering the valve chamber 107 and crankcase chamber 48, with oil injected for lubricating the valve train and parts in the crankcase chamber 48.

During the compression stroke when the piston assembly 756 travels upward, the intake valve 98 is closed and the crankcase chamber 48 experiences negative pressure and the charge (oil mixed charge) is inducted into the crankcase chamber 48 from the carburetor 500 through the passage 126*a*, the port 126, the chamber 88. The one-way valve 128 opens due to differential pressure cross the one-way valve (typically a reed valve is used). When the piston moves downward during power stroke and expansion stroke, the crankcase pressure is built-up. During the intake stroke, the intake valve 98 opens and the charge from the crankcase chamber 48 enters the combustion chamber 51. At the same time, the rich charge enters the combustion chamber 51 directly from the carburetor 500 through the passage 126*b*. The concept of dual passage (lean charge going into crankcase chamber 48 and rich charge going directly into combustion chamber is applicable to all mono-block engines.

The oil pump may be driven by the crankshaft 22 as shown in FIG. 12*b* or by the cam shaft 82 as shown in FIG. 5*b*. The pump may also be driven by the crankshaft halves 722*b*, shown in FIG. 9*b* (and FIG. 9) where the pump is mounted outboard. Fuel used in the oil injected engine may be propane gas commonly known as LPG (liquefied petroleum gas or compressed gaseous fuel.

Figure 14F:
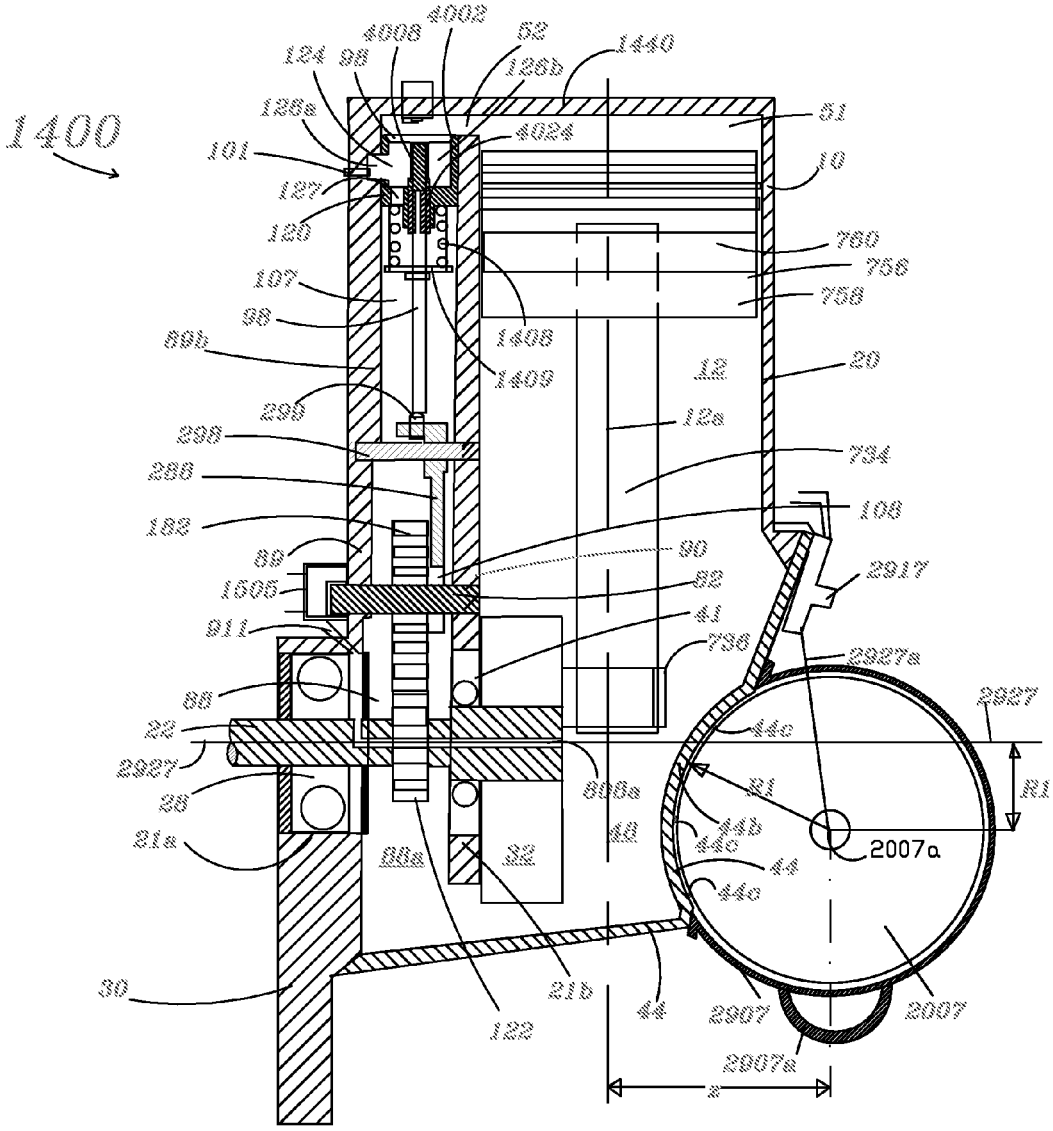
FIG. 14*f* is a cross-sectional side view illustration of an exemplary embodiment of a four-stroke engine with a L-head and a valve train with LPG fuel tank at the bottom.

FIG. 14*f* illustrates the location of an LPG fuel tank 2007 with a radius of curvature R1 near a crankcase cover having a recess in a fractional section 44*b* of the crankcase cover 44. The recess has a radius of curvature R1 plus a few millimeter (example 2 to 20 mm) to closely match and conform to an outer wall of the LPG fuel tank 2007 at the fractional section 44*b* of the crankcase cover 44. The radius of curvature on the crankcase cover 44 at section 44*b* is such that it provides enough clearance for the connecting rod 734 and crank pin 736 to freely rotate without interference. Secondly, a center line 2007*a* of the fuel tank 2007 is below an axis 2927 of the crankshaft 22 and the center line 2007*a* is off-set from the axis of the cylinder bore 12 when the fuel tank 2007 is located at the bottom of the engine as shown in FIG. 14*f*. When the attitude of the cylinder block 20 is such that crankcase chamber 48 is above the center line 2007*a* of the crankshaft 22, the fuel tank 2007 is located on the top of the crankcase cover 44. The LPG tank may also be located vertically in line with the axis 2927 of the cylinder 12. The advantage is a smaller package. Also, an oil tank containing lubricating oil to lubricate the engine may be attached to the fuel tank and above the center line 2007*a* of the fuel tank. The fuel tank 2007 is fitted inside a frame 2907 which may be attached to the crankcase cover 44 or cylinder block 20 or element. When the fuel tank 2007 is at the bottom, the frame 2907 has a leg 2907*a* for the engine block to rest on the floor. In order to minimize heating of fuel tank 2007 and provide a softer cushion between the crankcase cover 44 and fuel tank 2007, a vibration absorbent and low heat conductive material 44*c* is used between the fuel tank 2007 and crankcase cover 44 at section 44*b* as illustrated in FIG. 14*f*.

Engine 1400 shown in FIG. 14*f* has an oil injection pump 1505 driven by the cam shaft 82. The oil injection pump 1505 may also be driven by the crankshaft 22 through gears. The oil injection pump injects oil into the engine to lubricate the internal parts of the engine. An LPG pressure regulator 2917 is attached to the lower side of the cylinder block 20. Fuel from LPG tank is supplied to the pressure regulator through a centrally located high pressure fuel line 2927*a*.

The low cost simpler four-stroke engine is especially suited for hand-held, lawn and garden equipments such as trimmers, blowers, chain saws, cultivators, lawn mowers, compressor engines, and generator engines. The method manufacturing the cylinder block is simplified.

Conventional four-stroke engines have cam shaft and reduction gear for running the cam lobes at half the crankshaft speed to operate the intake and exhaust valves only once every two rotations of the crankshaft speed. However, in the mono-shaft engine, the cam lobe is either integral with the counter-weight or a separate piece mounted on the crankshaft in a chamber between the bearing bosses.

The mono-block engine reduces the number of parts, particularly, the half-crank engine and simplifies the method of assembling the full crank engine. Further, the engine design disclosed here is applicable to a full crank engine, where in both the outer and inner main bearing bosses are cast in as a single piece, but has a new assembly procedure.

Some four-stroke engines have a breather system for discharging excessive blow-by gases through the cam shaft, particularly, in the case of push tube type valve train system. The cam shaft, in this case, is substantially parallel to the crankshaft and is mounted between the cylinder head and the crankshaft. The breather passage is in the cam shaft and it can be a stationary shaft, where the cam gear and lobe are rotating on the shaft. Further, there can be a breather passage in the crankshaft connecting the chamber to the ambient (instead of breather passage in the cam shaft).

The compact mono-block design as disclosed for an L-head engine provides a significant advantage when an LPG fuel tank is attached to the crankcase cover.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

An internal combustion four-stroke engine includes a cylinder block 20 integrally cast with a portion of a crankcase 30 including crankcase outer and inner walls extending downwardly from the cylinder block 20 and integrally cast with a cylinder head 40 extending downwardly from the cylinder block 20. The engine further includes inner and outer bearing bosses 21*a* and 21*b* in the crankcase outer and inner walls respectively, an outboard wall 89 integral with the cast cylinder block 20, at least one cored out longitudinally extending open valve train embodiment of the chamber 88 disposed between the outboard wall 89 and the cast cylinder block 20, a half crankshaft 22 disposed through inner and outer bearings 41 and 28) supported within the inner and outer bearing bosses 21*a*, 21*b* respectively, and a valve train 2 extending through the chamber 88 operably connecting and for transmitting motion from the crankshaft 22 to intake and exhaust valves 98 and 99.

The engine may further include a counter-weight 32 mounted on the crankshaft 22 inboard of the inner bearing 41 and the valve train 2 may include push tubes 300 disposed in the valve train chamber 688 and operably associated and ridingly engaged with channels 609 in cam lobes 608 mounted on the half crankshaft 22 between the inner and outer bearings 41, 28.

An internal combustion four-stroke engine L-head engine includes an integrally cast four-stroke engine L-head mono-block 10 including a cylinder block 20 integrally cast with an L-head 1440 and at least portions of a crankcase 30 including crankcase outboard and inboard walls 89 and 90. At least parts of an outer bearing boss 21*a* and/or an inner bearing boss 21*b* are integrally cast in the outboard and inboard walls 89, 90 respectively with the cast cylinder block 20 and at least one cored out longitudinally extending open valve train chamber 88 is disposed between the outboard wall 89 and the cast cylinder block 20. The L-head 1440 covers the valve train chamber 88 and a cylinder bore 12 is disposed within the cylinder block 20 and spaced apart from inboard wall 90. A half crankshaft 22 is disposed through inner and outer bearings 41 and 28 supported within the inner and outer bearing bosses 21*a* and 21*b* respectively and a valve train 2 extends through the valve train chamber 88 operably connecting and for transmitting motion from the crankshaft 22 to intake and exhaust valves 98 and 99. The engine may further include an L-head valve chamber 107 in the valve train chamber 880 and an intake valve assembly 120 for intake and an exhaust valve assembly 120*b* for exhaust in the L-head valve chamber 107. A passage 502 may be incorporated to connect a carburetor 500 and the crankcase chamber 48 through a connecting passage 127 in the intake valve assembly 120. A one-way valve 128 may be disposed in the passage 502 to prevent flow back through the carburetor 500 into ambient and first and second intake passages 126*a* and 126*b* connecting the carburetor 500 to the combustion chamber 51 in the cylinder bore 12 through the intake valve assembly 120.

First and second intake passages 126*a* and 126*b* may be used to connect a carburetor 500 to a combustion chamber 51 in the cylinder bore 12 through the intake valve assembly 120 and a carburetor valve 584 of carburetor 500 having first and second valves 584*a* and 584*b* may be incorporated to regulate mass flow into the first and second intake passages 126*a* and 126*b* respectively.

At least some of the engines may further include a crankcase cover 1312 covering a crankcase chamber 48 within the crankcase 30 and separating the crankcase chamber 48 and from an oil sump 1348 between the crankcase cover 1312 and the sump wall 1344. A tube 1320 extending between the crankcase chamber 48 and the oil sump 1348 protrudes from the crankcase cover 1312 into the oil sump 1348. Alternatively, a pocket wall 1314 surrounding a pocket 1316 protrudes into the oil sump 1348. One or more oil passages 1328 in one or more standoff tubes 1324 may incorporated to protrude from the crankcase cover 1312 into the oil sump 1348.

The internal combustion engine may include a crankcase cover 44 covering a crankcase chamber 48 within the crankcase 30 and a fuel tank 2007 operable for holding liquefied petroleum gas or another compressed gaseous fuel for use in the engine and partially disposed in a recess 45 in the crankcase cover 44. The tank 2007 is spaced slightly apart from and conforms to the recess 45. An injecting tube 101 may be disposed in an intake passage 126 disposed between the carburetor 500 and the crankcase chamber 48. A crankcase cover 44 covering a crankcase chamber 48 within the crankcase 30 may be constructed to accommodate a fuel tank 2007 for holding liquefied petroleum gas or another compressed gaseous fuel for use in the engine. The tank is partially disposed in a recess 45 in the crankcase cover 44 and spaced slightly apart from and conforms to the recess 45.

Embodiments of the present invention provide a new mono-block and engine incorporating the mono-block and an improved method of cylinder manufacturing and assembling four-stroke and two-stroke engines. A single piece cylinder crankcase block for half and full crank allow for the manufacture and assembly of a lower cost engine. A simpler crankcase for dry sump lubrication can also be used as the dry sump engine/mist lubrication allows engines for any attitude operation when used in hand-held applications.

Accordingly, what is desired to be secured by Letters Patent of the United States is the invention as defined and differentiated in the following claims:

1. An integrally cast engine mono-block comprising:
- integrally cast cylinder block, cylinder head, and portion of a crankcase including crankcase outboard and inboard walls;
- at least parts of outer and inner bearing bosses integrally cast with the cylinder block;
- the inner bearing boss integrally cast in the inboard wall;
- at least one cored out longitudinally extending passage laterally disposed directly between the outboard wall and the cast cylinder block;
- the passage having an open top end;
- a lower opening at a lower end of the passage;
- a crankcase opening of the crankcase at a longitudinally lower end of the mono-block extending from a portion of an outer periphery of a longitudinally lower part of the cylinder block to a bottom portion of the outboard wall of the crankcase; and
  - the lower opening of the passage being located fully laterally inboard of the crankcase opening.

2. An integrally cast four-stroke engine mono-block comprising:
- integrally cast cylinder block, cylinder head, and portion of a crankcase including crankcase outboard and inboard walls;
- at least parts of an outer bearing boss and/or an inner bearing boss integrally cast in the outboard and inboard walls respectively with the cast cylinder block;
- at least one cored out longitudinally extending open valve train passage laterally disposed directly between the outboard wall and the cast cylinder block;
- a lower opening at a lower end of the passage;
- a crankcase opening of the crankcase at a longitudinally lower end of the mono-block extending from a portion of an outer periphery of a longitudinally lower part of the cylinder block to a bottom portion of the outboard wall of the crankcase; and
  - the lower opening of the passage being located fully laterally inboard of the crankcase opening.

3. The integrally cast four-stroke engine mono-block as claimed in claim 2 further comprising one or more cored out train passages in the valve train passage.

4. The integrally cast four-stroke engine mono-block as claimed in claim 3 further comprising the one or more cored out train passages in the valve train passage being push tube passages or a belt drive passage.

5. The integrally cast four-stroke engine mono-block as claimed in claim 2 further comprising an outer ignition boss integrally cast with the block.

6. The integrally cast four-stroke engine mono-block as claimed in claim 2 further comprising at least a portion of an outboard bearing boss integrally cast with the block.

7. The integrally cast four-stroke engine mono-block as claimed in claim 6 further comprising the portion being an upper half of the outboard bearing boss.

8. The integrally cast four-stroke engine mono-block as claimed in claim 2 further comprising a crankcase inboard wall integral with the block and at least portions of outer and inner bearing bosses in the outboard and inboard walls respectively.

9. The integrally cast four-stroke engine mono-block as claimed in claim 8 further comprising push tube passages or a belt drive passage in the valve train passage.

10. The integrally cast four-stroke engine mono-block as claimed in claim 8 further comprising an outer ignition boss integrally cast with the block.

11. The integrally cast four-stroke engine mono-block as claimed in claim 8 further comprising the portions including an upper half of the outboard bearing boss.

12. An integrally cast four-stroke engine mono-block comprising:

integrally cast cylinder block, cylinder head, and portion of a crankcase including crankcase outboard and inboard walls and an outboard wall extension;

an outboard bearing boss in the outboard wall extension and first and second bearing bores in the outboard and inboard walls respectively;

at least one cored out longitudinally extending open valve train passage laterally disposed directly between the outboard wall and the cast cylinder block; and a crankcase opening of the crankcase at a longitudinally lower end of the mono-block extending from a portion of an outer periphery of a longitudinally lower part of the cylinder block to a bottom portion of the outboard wall of the crankcase; and the lower opening of the passage being located fully laterally inboard of the crankcase opening.

13. An integrally cast four-stroke engine L-head mono-block comprising:

integrally cast cylinder block, L-head, and portion of a crankcase including crankcase outboard and inboard walls;

at least parts of an outer bearing boss and/or an inner bearing boss integrally cast in the outboard and inboard walls respectively with the cast cylinder block;

at least one cored out longitudinally extending open valve train passage disposed directly between the outboard wall and the cast cylinder block; and the L-head covering the valve train passage and a cylinder bore disposed within the cylinder block and spaced apart from inboard wall.

14. An internal combustion four-stroke engine comprising:

integrally cast cylinder block, cylinder head, and portion of a crankcase including crankcase outboard and inboard walls;

at least parts of outer and inner bearing bosses integrally cast with the cylinder block;

the inner bearing boss integrally cast in the inboard wall;

at least one cored out longitudinally extending open valve train passage disposed directly between the outboard wall and the cast cylinder block;

a piston assembly disposed within a cylinder bore of the cylinder block;

the piston assembly including a piston and a connecting rod connected to the piston by a piston pin; and a crank pin operably connecting the connecting rod to a counter-weight on a crankshaft disposed through and at least partially supported by an inner bearing in the inner bearing boss.

15. An internal combustion four-stroke engine comprising:

integrally cast cylinder block, cylinder head, and portion of a crankcase including crankcase outboard and inboard walls;

at least parts of an outer bearing boss and/or an inner bearing boss integrally cast in the outboard and inboard walls respectively with the cast cylinder block;

at least one cored out longitudinally extending open valve train passage disposed directly between the outboard wall and the cast cylinder block;

a piston assembly disposed within a cylinder bore of the cylinder block;

the piston assembly including a piston and a connecting rod connected to the piston by a piston pin; and a crank pin operably connecting the connecting rod to a counter-weight on a crankshaft disposed through and at least partially supported by an inner bearing in the inner bearing boss.

16. An internal combustion four-stroke engine comprising:

a cylinder block integrally cast with a portion of a crankcase including crankcase outer and inner walls extending downwardly from the cylinder block and integrally cast with a cylinder head extending downwardly from the cylinder block;

inner and outer bearing bosses in the crankcase outer and inner walls respectively;

an outboard wall integrally with the cast cylinder block;

at least one cored out longitudinally extending open valve train passage disposed directly between the outboard wall and the cast cylinder block;

a half crankshaft disposed through inner and outer bearings supported within the inner and outer bearing bosses respectively; and a valve train extending through the valve train passage operably connecting and for transmitting motion from the crankshaft to intake and exhaust valves.

17. The internal combustion four-stroke engine as claimed in claim 16 further comprising a counter-weight mounted on the crankshaft inboard of the inner bearing and the valve train including push tubes disposed in the valve train passage and operably associated and ridingly engaged with channels in cam lobes mounted on the half crankshaft between the inner and outer bearings.

18. The internal combustion four-stroke engine as claimed in claim 16 further comprising a counter-weight mounted on the crankshaft inboard of the inner bearing and the valve train including push tubes disposed in push tube passages in the valve train passage or the valve train passage being a belt drive passage and the valve train including a belt operably disposed in the belt drive passage and mounted on a crank pulley on the crankshaft.

19. The internal combustion four-stroke engine as claimed in claim 16 further comprising an oil injection pump mounted in the outboard wall, drivenly connected to a cam shaft drivenly connected to the half crankshaft, and operable connected to and for injecting oil into a first intake passage connecting a carburetor directly to a cylinder bore in the cylinder block or a crankcase chamber within the crankcase.

20. The internal combustion four-stroke engine as claimed in claim 19 further comprising a pressure sensor on the oil injection pump for killing the engine when oil pressure in an outlet of the oil injection pump falls below a predetermined value.

21. An internal combustion four-stroke L-head engine comprising:

an integrally cast four-stroke engine L-head mono-block including a cylinder block integrally cast with an L-head, and portion of a crankcase including crankcase outboard and inboard walls;

at least parts of an outer bearing boss and/or an inner bearing boss integrally cast in the outboard and inboard walls respectively with the cast cylinder block;

at least one cored out longitudinally extending open valve train passage disposed directly between the outboard wall and the cast cylinder block;

the L-head covering the valve train passage and a cylinder bore disposed within the cylinder block and spaced apart from inboard wall;

a half crankshaft disposed through inner and outer bearings supported within the inner and outer bearing bosses respectively; and a valve train extending through the valve train passage operably connecting and for transmitting motion from the crankshaft to intake and exhaust valves.

22. The internal combustion four-stroke L-head engine as claimed in claim 21 further comprising an L-head valve passage in the valve train passage and an intake valve assembly for intake and an exhaust valve assembly for exhaust in the L-head valve chamber.

23. The internal combustion four-stroke L-head engine as claimed in claim 22 further comprising a passage connecting a carburetor and the crankcase chamber through a connecting passage in the intake valve assembly.

24. The internal combustion four-stroke L-head engine as claimed in claim 23 further comprising a one-way valve in the passage operable to prevent flow back through the carburetor into ambient and first and second intake passages connecting the carburetor to a combustion chamber in the cylinder bore through the intake valve assembly.

25. The internal combustion four-stroke L-head engine as claimed in claim 22 further comprising first and second intake pass has connecting a liquid or gaseous fuel carburetor to a combustion chamber in the cylinder bore through the intake valve assembly and a carburetor valve of carburetor having first and second valves operable to regulate mass flow of air and air-fuel mixture into the first and second intake passages respectively.

26. The internal combustion four-stroke L-head engine as claimed in claim 25 further comprising means for connecting the carburetor directly to the cylinder bore during an intake process of engine and connecting the carburetor to the crankcase chamber during at least one upward stroke of the engine.

27. The internal combustion four-stroke L-head engine as claimed in claim 26 further comprising an injecting tube in an intake passage disposed between the carburetor and the crankcase chamber.

28. The internal combustion engine as claimed in claim 16 further comprising:

a crankcase cover covering a crankcase chamber within the crankcase and separating the crankcase chamber and from an oil sump between the crankcase cover and the sump wall; and a tube extending between the crankcase chamber and the oil sump and protruding from the crankcase cover into the oil sump or a pocket wall surrounding a pocket protruding into the oil sump.

29. The internal combustion engine as claimed in claim 28 further comprising one or more oil passages in one or more standoff tubes protruding from the crankcase cover into the oil sump.

30. The internal combustion engine as claimed in claim 16 further comprising:

a crankcase cover covering a crankcase chamber within the crankcase;

a fuel tank operable for holding liquefied petroleum gas or another compressed gaseous fuel for use in the engine;

the fuel tank partially disposed in a recess in a fractional section of the crankcase cover; and the tank spaced slightly apart from and conforming to the recess.

31. The internal combustion as claimed in claim 16 further comprising:

a valve chamber extending into a combustion chamber in the cylinder head and defining an upper portion of the combustion chamber;

a carburetor in fuel supply communication with the crankcase chamber through a port in the cylinder block;

the valve train passage extend from an opening to the crankcase chamber to the valve chamber; and the intake valve operable for opening and closing a passage extending between the valve chamber and the combustion chamber.

32. An internal combustion engine comprising:

integrally cast cylinder block, cylinder head, and portion of a crankcase including crankcase outboard and inboard walls;

inner and outer bearing bosses integrally cast in the crankcase outboard and inboard walls;

at least one cored out longitudinally extending passage laterally disposed at least directly between the outboard and inboard walls;

a lower opening at a lower end of the passage;

a crankcase opening of the crankcase at a longitudinally lower end of the mono-block extending from a portion of an outer periphery of a longitudinally lower part of the cylinder block to a bottom portion of the outboard wall of the crankcase;

the lower opening of the passage being located fully laterally inboard of the crankcase opening;

a piston assembly disposed within a cylinder bore of the cylinder block;

the piston assembly including a piston and a connecting rod connected to the piston by a piston pin; and a crank pin operably connecting the connecting rod to a counter-weight on a crankshaft disposed through and at least partially supported by an inner bearing in the inner bearing boss.

33. The internal combustion as claimed in claim 32 further comprising an oil injection pump disposed in the passage between the outboard and inboard walls, drivenly connected to a cam shaft drivenly connected to the half crankshaft, and operable for injecting oil into a crankcase chamber within the crankcase.

34. The internal combustion engine as claimed in claim 33 further comprising a pressure sensor on the oil injection pump for killing the engine when oil pressure in an outlet of the oil injection pump falls below a predetermined value.

35. The internal combustion as claimed in claim 32 further comprising an oil injection pump disposed in the passage between the outboard and inboard walls, drivenly connected to the crankshaft, and operable for injecting oil into a crankcase chamber within the crankcase.

36. An internal combustion engine comprising:
integrally cast cylinder block and portion of a crankcase including crankcase outboard and inboard walls;
inner and outer bearing bosses integrally cast in the crankcase outboard and inboard walls;
at least one passage laterally disposed at least directly between the outboard and inboard walls;
an opening at a lower or upper end of the passage;
a crankcase opening of the crankcase at a longitudinally lower end of the mono-block extending from a portion of an outer periphery of a longitudinally lower part of the cylinder block to a bottom portion of the outboard wall of the crankcase;
a piston assembly disposed within a cylinder bore of the cylinder block;
the piston assembly including a piston and a connecting rod connected to the piston by a piston pin;
a crank pin operably connecting the connecting rod to a counter-weight on a crankshaft disposed through and at least partially supported by an inner bearing in the inner bearing boss; and
an oil injection pump disposed in the passage between the outboard and inboard walls, drivenly connected to the crankshaft, and operable for injecting oil into a crankcase chamber within the crankcase.

37. An internal combustion four-stroke engine comprising:
a cylinder block and a cylinder bore within the cylinder block,
a crankcase including crankcase outer and inner walls extending downwardly from the cylinder block,
inner and outer bearing bosses in the crankcase outer and inner walls respectively,
an outboard wall connected to the cylinder block,
at least one cored out longitudinally extending open valve train passage laterally disposed directly between the outboard wall and the cylinder block,
a crankcase cover covering a crankcase chamber within the crankcase,
a fuel tank attached to the engine and operable for holding liquefied petroleum gas or another compressed gaseous fuel for use in the engine, and
the fuel tank partially disposed in a recess in a fractional section of the crankcase cover.

38. An internal combustion four-stroke engine comprising:
a cylinder block and a cylinder bore within the cylinder block,
a crankcase including crankcase outer and inner walls extending downwardly from the cylinder block,
inner and outer bearing bosses in the crankcase outer and inner walls respectively,
an outboard wall connected to the cylinder block,
a half crankshaft disposed through inner and outer bearings supported within the inner and outer bearing bosses respectively,
a crankcase cover disposed at a bottom of the crankcase and covering a crankcase chamber within the crankcase, and
an oil sump containing oil within the crankcase.

39. An internal combustion four-stroke engine comprising:
a cylinder block and a cylinder bore within the cylinder block,
a crankcase including crankcase outer and inner walls extending downwardly from the cylinder block,
inner and outer bearing bosses in the crankcase outer and inner walls respectively,
an outboard wall connected to the cylinder block,
a half crankshaft disposed through inner and outer bearings supported within the inner and outer bearing bosses respectively, and
a crankcase cover covering a crankcase chamber within the crankcase and separating the crankcase chamber and from an oil sump between the crankcase cover and the sump wall.

40. An internal combustion four-stroke engine comprising:
a cylinder block and a cylinder bore within the cylinder block,
a crankcase including crankcase outer and inner walls extending downwardly from the cylinder block,
inner and outer bearing bosses in the crankcase outer and inner walls respectively,
an outboard wall connected to the cylinder block,
at least one longitudinally extending open valve train passage disposed directly between the outboard wall and the cylinder block,
a half crankshaft disposed through inner and outer bearings supported within the inner and outer bearing bosses respectively,
a valve train extending through the valve train passage operably connecting and for transmitting motion from the crankshaft to intake and exhaust valves,
a crankcase cover covering a crankcase chamber within the crankcase,
a fuel tank attached to the engine and operable for holding liquefied petroleum gas or another compressed gaseous fuel for use in the engine, and
a center line of the fuel tank off-set from an axis of the cylinder bore.

41. An internal combustion four-stroke engine comprising:
a cylinder block and a cylinder bore within the cylinder block,
a crankcase including crankcase outer and inner walls extending downwardly from the cylinder block,
inner and outer bearing bosses in the crankcase outer and inner walls respectively,
an outboard wall connected to the cylinder block,
at least one cored out longitudinally extending open valve train passage disposed directly between the outboard wall and the cylinder block,
a half crankshaft disposed through inner and outer bearings supported within the inner and outer bearing bosses respectively,
a valve train extending through the valve train passage operably connecting and for transmitting motion from the crankshaft to intake and exhaust valves,
a crankcase cover covering a crankcase chamber within the crankcase,
a fuel tank attached to the engine and operable for holding liquefied petroleum gas or another compressed gaseous fuel for use in the engine, and
a center line of the fuel tank offset above or below an axis of the crankshaft.

42. An internal combustion four-stroke engine comprising:
a cylinder block and a cylinder bore within the cylinder block,
a crankcase including crankcase outer and inner walls extending downwardly from the cylinder block,
inner and outer bearing bosses in the crankcase outer and inner walls respectively,
an outboard wall connected to the cylinder block,
at least one cored out longitudinally extending open valve train passage disposed directly between the outboard wall and the cylinder block, a half crankshaft disposed through inner and outer bearings supported within the inner and outer bearing bosses respectively, a valve train extending through the valve train passage operably connecting and for transmitting motion from the crankshaft to intake and exhaust valves, a crankcase cover covering a crankcase chamber within the crankcase, a fuel tank attached to the engine and operable for holding liquefied petroleum gas or another compressed gaseous fuel for use in the engine, the fuel tank disposed inside a frame attached to the engine, and the frame including a leg operable for the engine to rest on the floor.

43. An internal combustion four-stroke engine comprising:

a cylinder block and a cylinder bore within the cylinder block, a crankcase including crankcase outer and inner walls extending downwardly from the cylinder block, inner and outer bearing bosses in the crankcase outer and inner walls respectively, an outboard wall connected to the cylinder block, at least one longitudinally extending open valve train passage disposed directly between the outboard wall and the cylinder block, a half crankshaft disposed through inner and outer bearings supported within the inner and outer bearing bosses respectively, a valve train extending through the valve train passage operably connecting and for transmitting motion from the crankshaft to intake and exhaust valves, a crankcase cover covering a crankcase chamber within the crankcase, a fuel tank attached to the engine and operable for holding liquefied petroleum gas or another compressed gaseous fuel for use in the engine, and the fuel tank disposed inside a frame attached to the engine.

44. An internal combustion four-stroke engine comprising:

a cylinder block and a cylinder bore within the cylinder block, a crankcase including at least one bearing boss in a crankcase wall, a crankshaft disposed through bearings supported within the bearing boss, a valve train connecting and for transmitting motion from the crankshaft to intake and exhaust valves to the cylinder bore, a crankcase cover covering a crankcase chamber within the crankcase, a fuel tank attached to the engine and operable for holding liquefied petroleum gas or another compressed gaseous fuel for use in the engine, and a center line of the fuel tank offset above or below an axis of the crankshaft.

45. An internal combustion two-stroke engine comprising:

a cylinder block and a cylinder bore within the cylinder block, a crankcase including crankcase outer and inner walls extending downwardly from the cylinder block, outer and inner bearing bosses in the crankcase outer and inner walls respectively, an outboard wall connected to the cylinder block, a crankcase cover covering a crankcase chamber within the crankcase, a fuel tank attached to the engine and operable for holding liquefied petroleum gas or another compressed gaseous fuel for use in the engine, and the fuel tank partially disposed in a recess in a fractional section of the crankcase cover.

46. The internal combustion two-stroke engine as claimed in claim 45 further comprising a vibration absorbent and low heat conductive material disposed in the recess between the fuel tank and the crankcase cover.

47. An internal combustion two-stroke engine comprising:

a cylinder block and a cylinder bore within the cylinder block, a crankcase including at least one crankcase wall extending downwardly from the cylinder block, at least one bearing boss in the crankcase wall, an outboard wall connected to the cylinder block, a half crankshaft disposed through at least one bearing supported within the bearing boss, a crankcase cover covering a crankcase chamber within the crankcase, and a fuel tank attached to the engine and operable for holding liquefied petroleum gas or another compressed gaseous fuel for use in the engine, and the fuel tank partially disposed in a recess in a fractional section of the crankcase cover.

48. An internal combustion four-stroke engine comprising:

a cylinder block integrally cast with a portion of a crankcase including crankcase outer and inner walls extending downwardly from the cylinder block and integrally cast with a cylinder head extending downwardly from the cylinder block, at least one bearing boss in one of the crankcase walls, an outboard wall integrally with the cast cylinder block, at least one cored out longitudinally extending open valve train passage disposed directly between the outboard wall and the cast cylinder block, a crankshaft disposed through at least one bearing supported within the bearing boss, a valve train extending through the valve train passage operably connecting and for transmitting motion from the crankshaft to intake and exhaust valves, a counter-weight mounted on the crankshaft inboard of the inner bearing, the valve train including push tubes disposed in the valve train passage and operably associated and engaged with channels in a cam lobe mounted on the crankshaft between the inner and outer bearings, and a breather passage in the crankshaft for communication between a crankcase chamber in the crankcase and ambient.

49. An internal combustion four-stroke engine comprising:

a cylinder block and a cylinder bore within the cylinder block, a crankcase including crankcase outer and inner walls extending downwardly from the cylinder block, inner and outer bearing bosses in the crankcase outer and inner walls respectively, an outboard wall connected to the cylinder block, at least one cored out longitudinally extending open valve train passage disposed directly between the outboard wall and the cylinder block, a half crankshaft disposed through inner and outer bearings supported within the inner and outer bearing bosses respectively, a valve train extending through the valve train passage operably connecting and for transmitting motion from the crankshaft to intake and exhaust valves, a crankcase cover covering a crankcase chamber within the crankcase, the crankcase chamber located above an axis of the crankshaft, a fuel tank attached to the engine and operable for holding liquefied petroleum gas or another compressed gaseous fuel for use in the engine, and a fuel tank attached to the engine above the center line of the crankshaft.

* * * * *